US008845562B2

(12) United States Patent
Receveur et al.

(10) Patent No.: US 8,845,562 B2
(45) Date of Patent: Sep. 30, 2014

(54) GAS SUPPLY SYSTEM

(75) Inventors: Timothy J. Receveur, Guilford, IN (US); David Ribble, Indianapolis, IN (US); Sandy M. Richards, Pershing, IN (US); Stephen L. Douglas, Batesville, IN (US); Eric R. Meyer, Greensburg, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 390 days.

(21) Appl. No.: 12/840,609

(22) Filed: Jul. 21, 2010

(65) Prior Publication Data

US 2012/0022414 A1 Jan. 26, 2012

(51) Int. Cl.
*A61H 7/00* (2006.01)

(52) U.S. Cl.
USPC ..... 601/84; 601/148; 5/710; 602/13

(58) Field of Classification Search
USPC ..... 601/41–44, 134–135, 148, 151, 152, 601/84; 128/DIG. 20; 602/13; 5/710, 715, 5/81.1 R
See application file for complete search history.

(56) References Cited

U.S. PATENT DOCUMENTS

| | | | | |
|---|---|---|---|---|
| 4,858,596 | A | 8/1989 | Kolstedt et al. | |
| 5,575,762 | A | 11/1996 | Peeler et al. | |
| 5,588,954 | A | 12/1996 | Ribando et al. | |
| 5,588,955 | A | 12/1996 | Johnson, Jr. et al. | |
| 5,630,238 | A | 5/1997 | Weismiller et al. | |
| 5,674,262 | A | 10/1997 | Tumey | |
| 5,715,548 | A | 2/1998 | Weismiller et al. | |
| 5,840,049 | A | 11/1998 | Tumey et al. | |
| 5,843,007 | A | 12/1998 | McEwen et al. | |
| 5,876,359 | A | 3/1999 | Bock et al. | |
| 5,997,488 | A * | 12/1999 | Gelfand et al. | 601/41 |
| 6,080,120 | A | 6/2000 | Sandman et al. | |
| 6,231,532 | B1 | 5/2001 | Watson et al. | |
| 6,463,934 | B1 | 10/2002 | Johnson, Jr. et al. | |
| 6,544,202 | B2 | 4/2003 | McEwen et al. | |
| 7,343,916 | B2 | 3/2008 | Biondo et al. | |
| 7,641,623 | B2 | 1/2010 | Biondo et al. | |
| 7,681,269 | B2 * | 3/2010 | Biggie et al. | 5/715 |
| 7,849,544 | B2 * | 12/2010 | Flocard et al. | 5/710 |
| 7,976,572 | B2 * | 7/2011 | Ziaimehr | 607/96 |
| 8,104,126 | B2 * | 1/2012 | Caminade et al. | 5/715 |
| 8,108,957 | B2 | 2/2012 | Richards et al. | |
| 8,584,279 | B2 | 11/2013 | Richards et al. | |
| 2002/0144343 | A1 * | 10/2002 | Kuiper et al. | 5/81.1 R |
| 2004/0002270 | A1 * | 1/2004 | Courtney | 441/40 |
| 2005/0046182 | A1 * | 3/2005 | Trapp et al. | 285/139.1 |
| 2005/0062284 | A1 * | 3/2005 | Schreiner et al. | 285/139.1 |
| 2006/0149176 | A1 | 7/2006 | Bolam et al. | |
| 2006/0258964 | A1 | 11/2006 | Biondo et al. | |

(Continued)

FOREIGN PATENT DOCUMENTS

| | | | |
|---|---|---|---|
| WO | 9817154 | A1 | 4/1998 |
| WO | 2004091463 | A2 | 10/2004 |
| WO | 2008127868 | A1 | 10/2008 |

*Primary Examiner* — Michael A. Brown
(74) *Attorney, Agent, or Firm* — Barnes & Thornburg LLP

(57) ABSTRACT

A gas supply system comprises a person-support surface, a garment, and a gas supply. The person-support surface includes a chamber configured to contain a gas therein. The garment includes a chamber configured to contain a gas therein. The gas supply is configured to supply a gas to both the garment and the person-support surface.

38 Claims, 17 Drawing Sheets

(56) References Cited

U.S. PATENT DOCUMENTS

| | | | | |
|---|---|---|---|---|
| 2009/0013470 | A1 | 1/2009 | Richards et al. | |
| 2009/0194115 | A1* | 8/2009 | Squitieri | 128/847 |
| 2009/0260639 | A1* | 10/2009 | Hsu et al. | 128/888 |
| 2010/0100017 | A1* | 4/2010 | Maguina | 601/152 |
| 2010/0274331 | A1 | 10/2010 | Williamson et al. | |
| 2011/0024076 | A1 | 2/2011 | Lachenbruch et al. | |
| 2012/0016281 | A1 | 1/2012 | Richards et al. | |

* cited by examiner

GAS SUPPLY SYSTEM

BACKGROUND OF THE DISCLOSURE

This disclosure relates generally to a gas supply system. More particularly, but not exclusively, one illustrative embodiment relates to a gas supply system configured to supply gas to a person-support surface and a pneumatic device.

Caregivers can be required to administer therapies and/or perform procedures on people supported on person-support surfaces. Some of the devices used for therapies and/or procedures can be powered by a gas, such as, for example, air. While various gas supply systems have been developed, there is still room for improvement. Thus a need persists for further contributions in this area of technology.

SUMMARY OF THE DISCLOSURE

The present disclosure includes one or more of the features recited in the appended claims and/or the following features which, alone or in any combination, may comprise patentable subject matter.

One illustrative embodiment of the present disclosure can include a gas supply system with a person-support surface having a chamber configured to contain a gas, a garment having a chamber configured to contain a gas, and a gas supply configured to communicate a gas to the garment and the person-support surface. In another illustrative embodiment, the gas supply system can include a gas supply configured to communicate a gas to a first chamber of a garment at a first gas flow rate for a first period of time to maintain the garment at a first pressure, communicate a gas to the garment at a second gas flow rate for a second period of time to maintain the first chamber at a second pressure, sense a gas pressure in a second chamber of a person-support surface, and communicate a gas to the second chamber at a third gas flow rate for a third period of time to maintain the second chamber at a third pressure. In another illustrative embodiment, the gas supply system can include a person-support surface, a microclimate management topper, a pneumatic device, and a gas supply configured to supply a gas to the pneumatic device and at least one of the microclimate management topper and the person-support surface.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
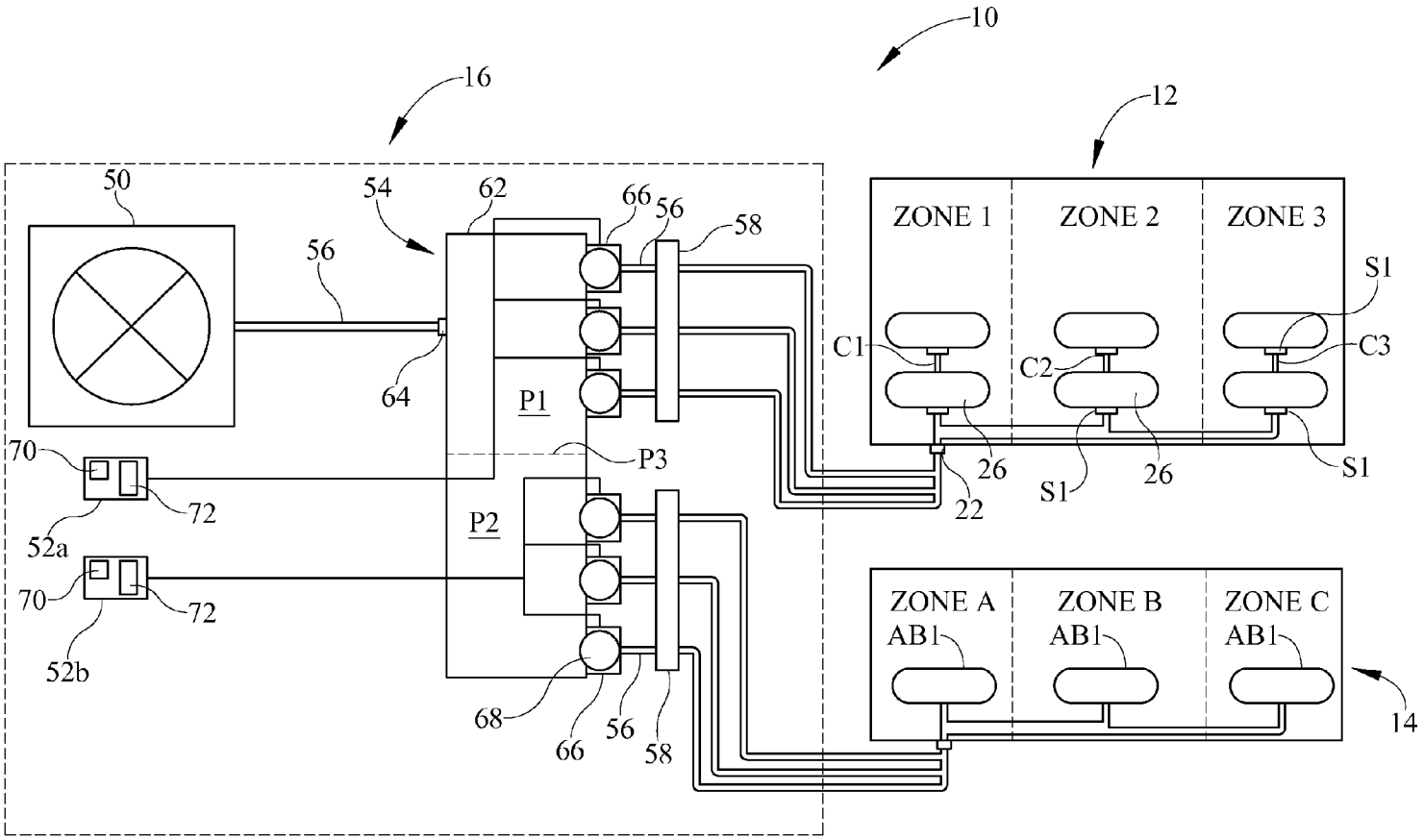
FIG. 1 is a diagrammatic view of the gas supply system including a person-support surface, a pneumatic device, and a gas supply assembly according to one illustrative embodiment of the current disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One illustrative embodiment of the present disclosure can include a gas supply system with a person-support surface having a chamber configured to contain a gas, a garment having a chamber configured to contain a gas, and a gas supply configured to communicate a gas to the garment and the person-support surface. In another illustrative embodiment, the gas supply system can include a gas supply configured to communicate a gas to a first chamber of a garment at a first gas flow rate for a first period of time to maintain the garment at a first pressure, communicate a gas to the garment at a second gas flow rate for a second period of time to maintain the first chamber at a second pressure, sense a gas pressure in a second chamber of a person-support surface, and communicate a gas to the second chamber at a third gas flow rate for a third period of time to maintain the second chamber at a third pressure. In another illustrative embodiment, the gas supply system can include a person-support surface, a microclimate management topper, a pneumatic device, and a gas supply configured to supply a gas to the pneumatic device and at least one of the microclimate management topper and the person-support surface.

A gas supply system 10 according to one illustrative embodiment of the current disclosure is shown in FIGS. 1 and 6-10. The gas supply system 10 can include a person-support surface 12, a pneumatic device 14 external to the person-support surface 12, and a gas supply assembly 16. The gas supply system 10 can be configured to provide support to a person positioned on the person-support surface 12 and/or power the pneumatic device 14.

Figure 2:
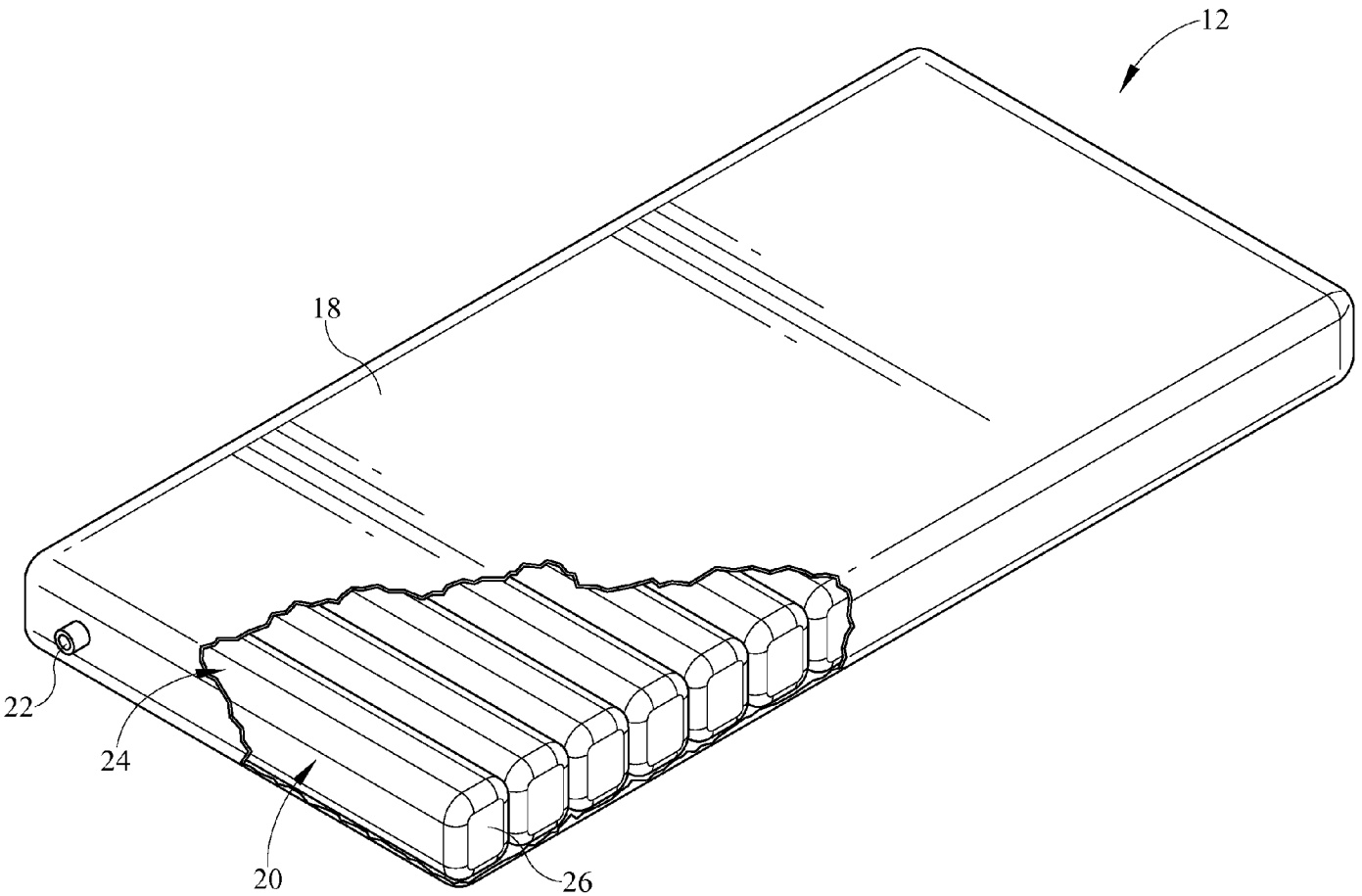
FIG. 2 is a side perspective view of the person-support surface of FIG. 1.

The person-support surface 12 or mattress 12 can include an outer mattress cover 18 or mattress ticking 18, a mattress core 20, and an inlet 22 as shown in FIG. 2. It should be appreciated that the person-support surface 12 can include a low-air loss therapy topper (not shown) thereon. The mattress cover 18 can define a mattress chamber 24 that the mattress core 20 can be positioned within. The mattress core 20 can include a plurality of gas bladders 26 and a plurality of sensors S1 configured to sense the fluid pressure within the gas bladders 26. It should be appreciated that the sensors S1 can be sense lines (not shown) that can be coupled to the gas bladders 26. The gas bladders 26 can be connected together by conduits C1, C2, and C3 and can receive gas from the gas supply assembly 16 through the inlet 22 positioned on a side, end, and/or bottom of the person-support surface 12 as shown in FIG. 2. The plurality of gas bladders 26 can be arranged to define zones Zone 1, Zone 2, and Zone 3 as shown in FIG. 1. It should be appreciated that the mattress core 20 can contain only one gas bladder 26. It should also be appreciated that the core 20 can include polymeric material, such as, foam, or a combination of polymeric material, bladders, gel, and/or fluidizable material. In one illustrative embodiment, the gas bladders 26 can extend longitudinally along the length of the person-support surface 12 and can be positioned adjacent one another. In another illustrative embodiment, the gas bladders 26 can extend laterally across the width of the person-support surface 12 and can be positioned adjacent one another. In still another illustrative embodiment, at least one gas bladder 26 can extend longitudinally along the length of the person-support surface 12 can be positioned above or below at least one other gas bladder 26 that can extend laterally across the width of the person-support surface 12.

The pressure in the gas bladders 26 can be varied by zone to provide support and/or therapy to a person positioned thereon. In one illustrative embodiment, the gas bladders 26 in Zone 1, Zone 2, and/or Zone 3 can be alternately inflated and deflated to create a form of alternating pressure therapy and/or percussion/vibration therapy. In another illustrative embodiment, the gas bladders 26 in Zone 1, Zone 2, and/or Zone 3 can be inflated and/or deflated to provide lateral rotation therapy. It should be appreciated that the gas bladders 26 and/or other components can provide therapy to the person through expansion and/or contraction, changes in pressure, and/or blowing air. It should also be appreciated that the person-support surface 12 can be configured to provide other therapies, including, but not limited to, low air loss therapy, and/or can be configured to boost a person and/or assist a caregiver attempting to turn a person.

Figure 3:
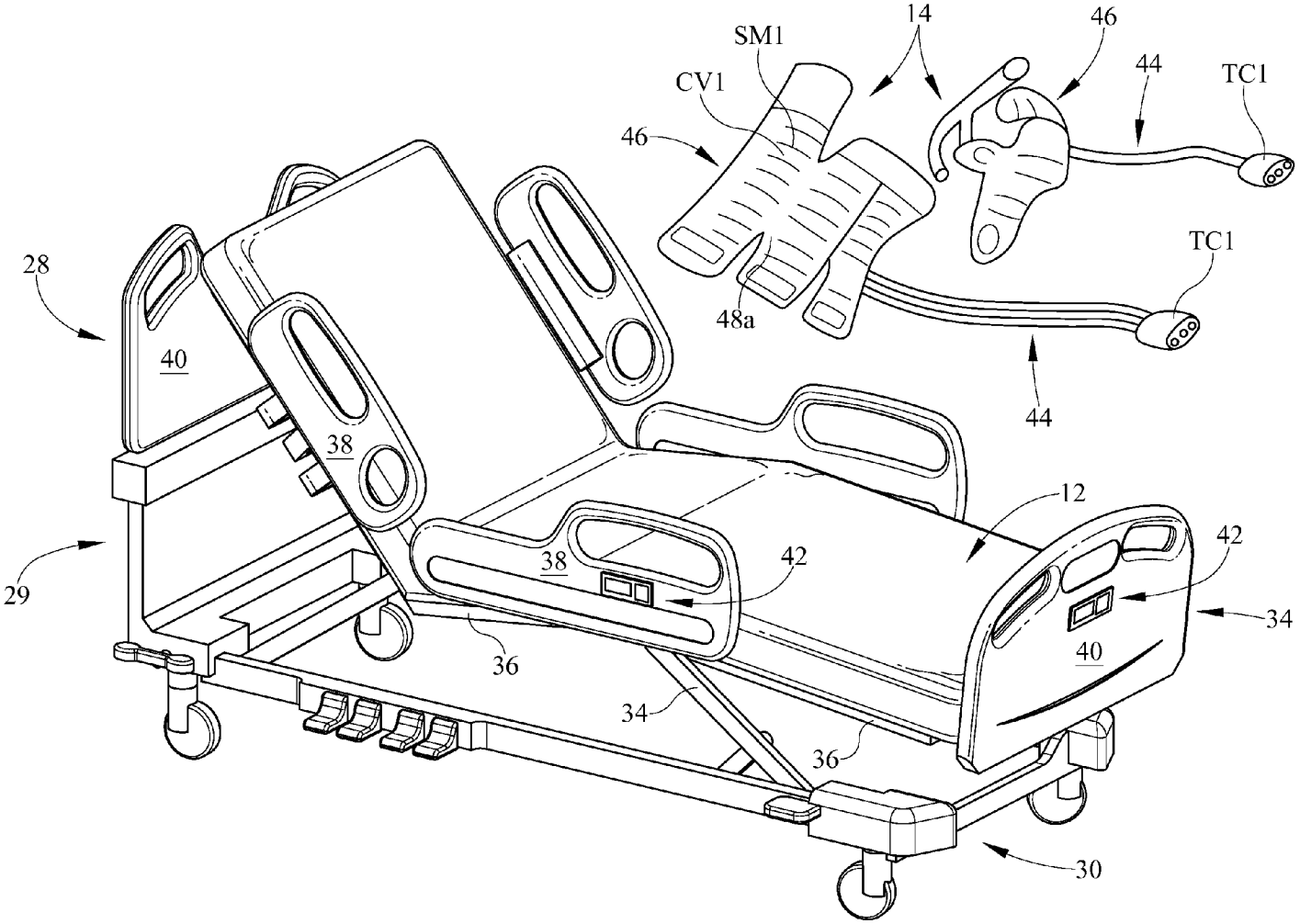
FIG. 3 is a side perspective view of a person-support apparatus supporting the person-support surface of FIG. 1.

The person-support surface 12 can be supported on a person-support apparatus 28 as shown in FIG. 3 according to one illustrative embodiment. The person-support apparatus 28 can be a hospital bed and can include a frame 29 with a lower frame 30, an upper frame 32, and a plurality of supports 34 coupled to the upper frame 32 and the lower frame 30. It should be appreciated that the person-support apparatus 28 can also be a hospital stretcher or an operating table. The upper frame 32 can be supported by the support 34 above the lower frame 30 and can be movable with respect to the lower frame 30. The upper frame 32 can include a deck 36, a siderail 38, and an endboard 40. The siderail 38 and the endboard 40 can be coupled to the upper frame 32 and can cooperate with the deck 36 to locate the perimeter of the upper frame 32. The siderail 38 and/or the endboard 40 can include a user interface 42 configured to control at least one function of the person-support apparatus 28, the person-support surface 12, and/or the gas supply assembly 16.

Figure 4:
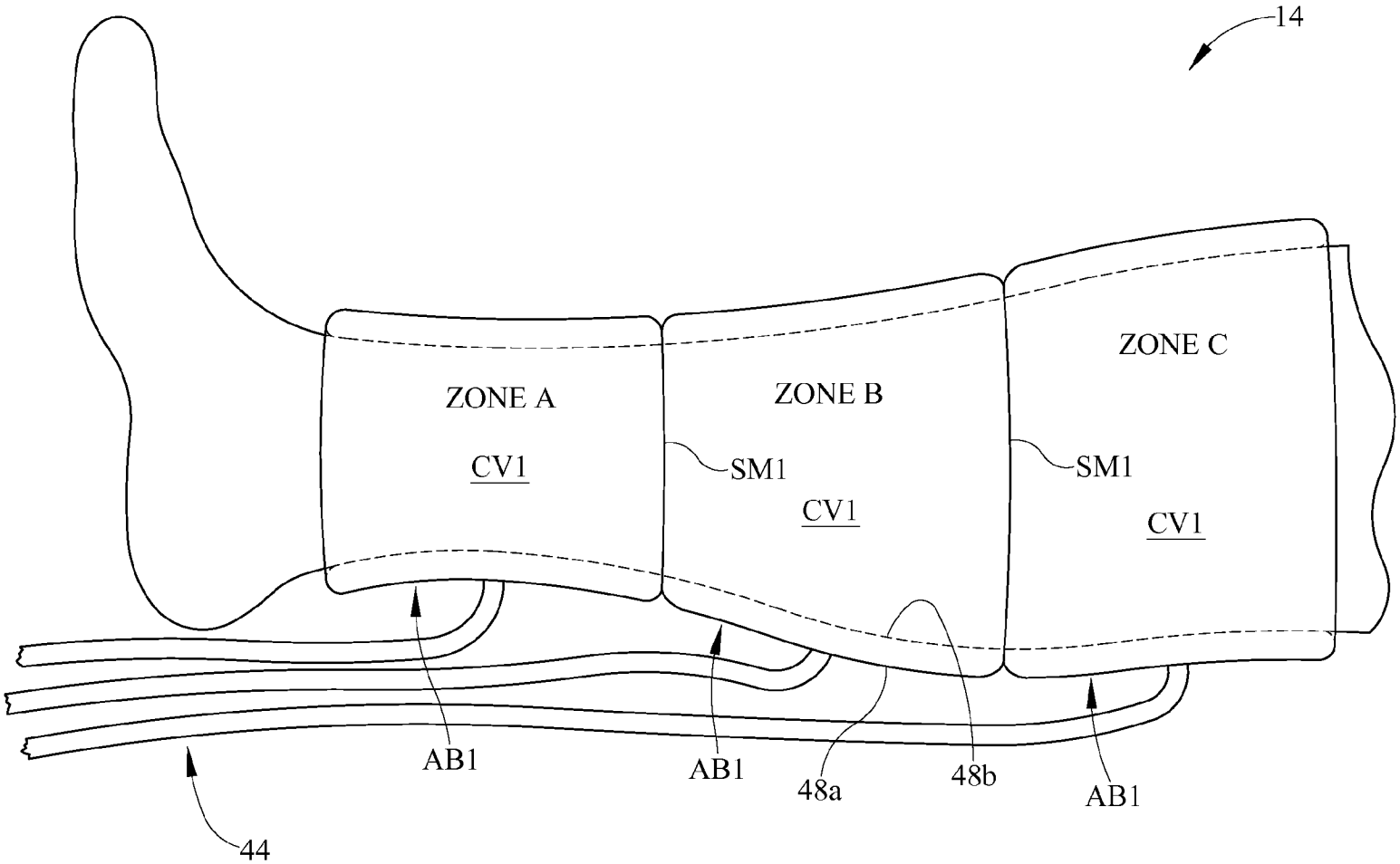
FIG. 4 is a side view of the pneumatic device of FIG. 1 according to one illustrative embodiment.
Figure 5:
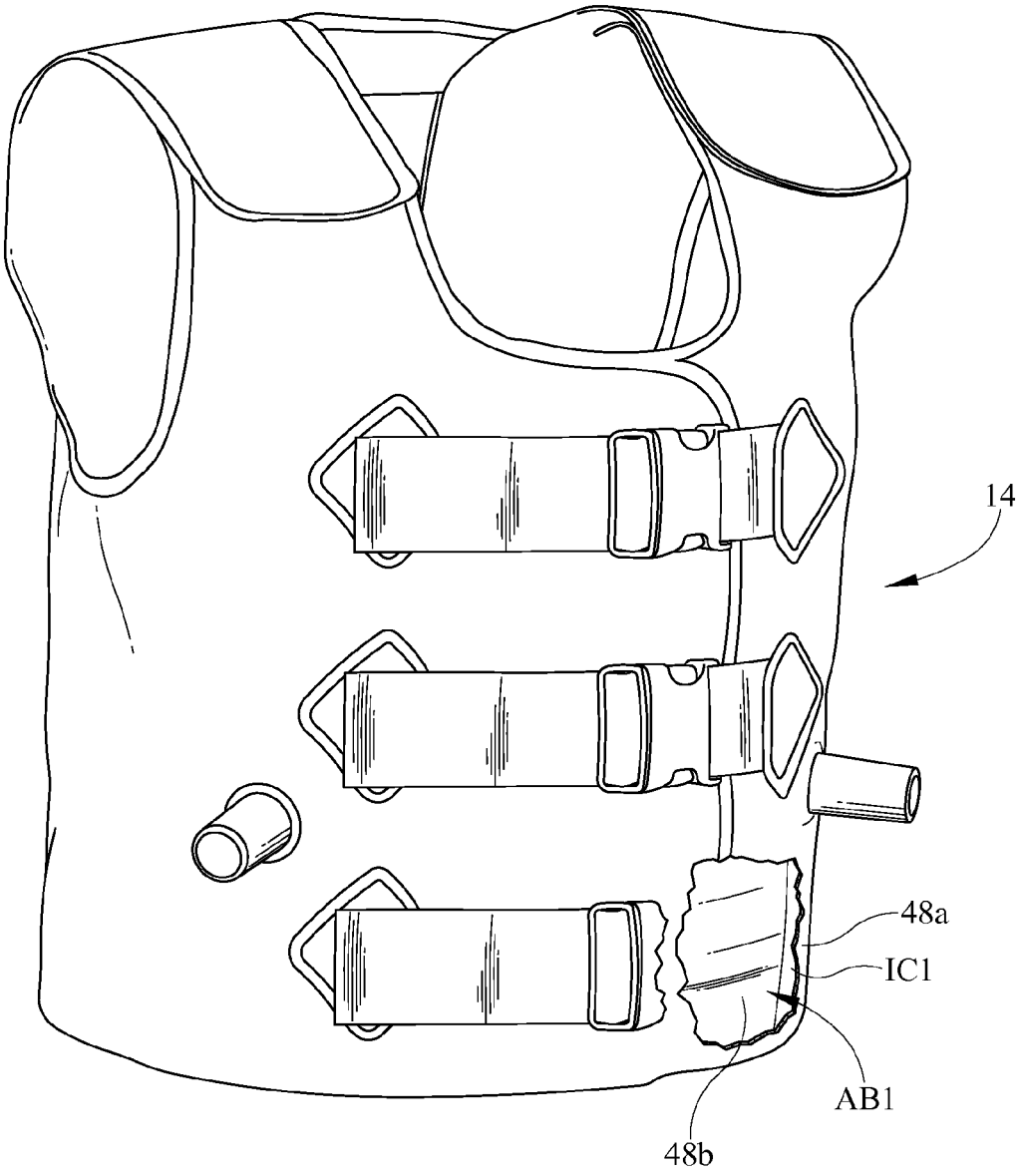
FIG. 5 is a side view of the pneumatic device of FIG. 1 according to another illustrative embodiment.

The pneumatic device 14 can be a variety of devices configured to be powered by a gas. In one illustrative embodiment, the pneumatic device can be a compression therapy device 14 as shown in FIG. 4. In another illustrative embodiment, the pneumatic device 14 can be a high frequency chest wall oscillation device as shown in FIG. 5. In still other embodiments, the pneumatic device can be other pneumatic medical equipment, such as, for example, a nebulizer, or instruments, such as, for example, pneumatic surgical tools. The compression therapy device 14 and/or the chest wall oscillation device 14 can include a hose assembly 44 and a garment 46 that can be sized and configured to encompass a portion of a person's body, such as, for example, a person's leg or torso, as shown in FIGS. 4-5. It should be appreciated that the compression therapy devices 14 can be the compression sleeve assemblies disclosed in U.S. Pat. No. 7,641,623 issued on Jan. 5, 2010 to Biondo, et al., which is hereby incorporated by reference. It should be appreciated that the chest wall oscillation device 14 can be The Vest® manufactured and sold by Hill-Rom, Inc®. It should also be appreciated that the chest wall oscillation device 14 can be the garment disclosed in U.S. Pat. No. 4,838,263 issued on Jun. 13, 1989 to Warwick, et al., which is hereby incorporated by reference.

The hose assembly 44 can be configured to provide fluid communication between the gas supply assembly 16 and the garment 46 as shown in FIGS. 1 and 3-10. In one illustrative embodiment, the hose assembly 44 can be coupled to the gas supply assembly 16 via a therapy connector TC1 and coupled to the garment 46. The hose assembly 44 can be configured to communicate a gas from the gas supply assembly 16 to the garment 46.

The garment 46 can be configured to include at least one gas bladder AB 1. In one illustrative embodiment, the pneumatic device 14 can include a first surface 48*a* and a second surface 48*b* that can be selectively attached to one another along at least one seam SM1 to form convolutions CV1 in the garment 46 as shown in FIG. 4. The convolutions CV1 can be configured to act as air bladders AB1 that can be inflated by the gas supplied by the gas supply assembly 16 via the hose assembly 44. The convolutions CV1 can be divided into inflatable zones Zone A, Zone B, and Zone C. that can include at least one convolution CV1. In another illustrative embodiment, the pneumatic device 14 can include a first surface 48*a* and a second surface 48*b* that can be selectively attached to one another along the edges ED1 as shown in FIG. 5. The first surface 48*a* can cooperate with the second surface 48*b* to form an inner chamber IC1 that can define the at least one gas bladder AB1.

The gas supply assembly 16 can be configured to supply fluid to the person-support surface 12 and the pneumatic device 14. In one illustrative embodiment, the gas supply assembly 16 can include a gas supply 50, a controller 52, a manifold assembly 54, a plurality of conduits 56, and a connector 58 as shown in FIGS. 6-10. It should be appreciated that the gas supply assembly 16 can include a first gas supply 50*a* configured to supply air for the person-support surface 12 and a second gas supply 50*b* configured to supply air for the person-support surface 12 as shown in FIG. 1.

Figure 6:
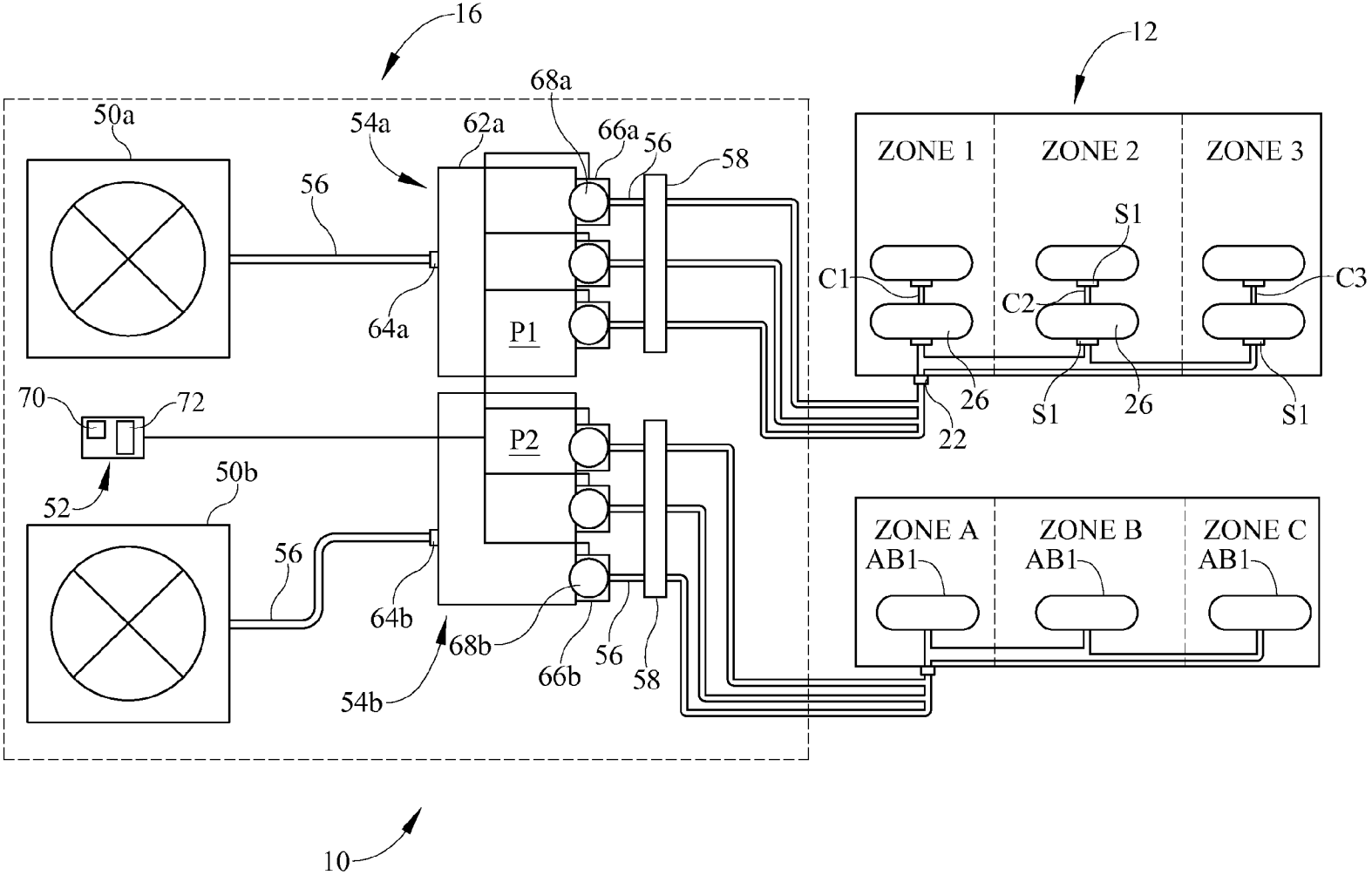
FIG. 6 is a diagrammatic view of the gas supply system of FIG. 1 according to another illustrative embodiment, wherein the gas supply system includes two gas supplies.
Figure 7:
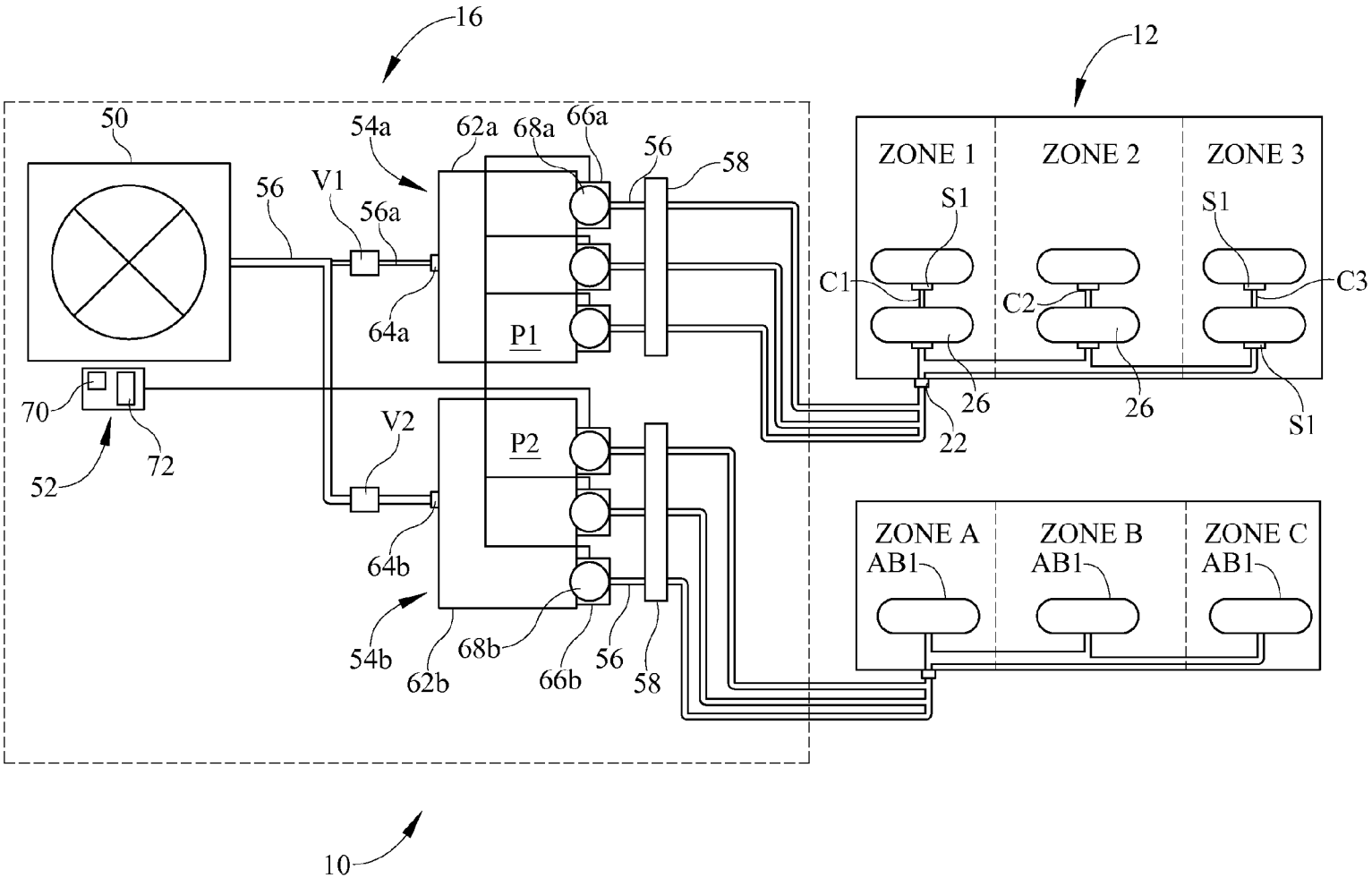
FIG. 7 is a diagrammatic view of the gas supply system of FIG. 1 according to yet another illustrative embodiment, wherein the gas supply assembly includes valves positioned between the manifold and the gas supply.
Figure 8:
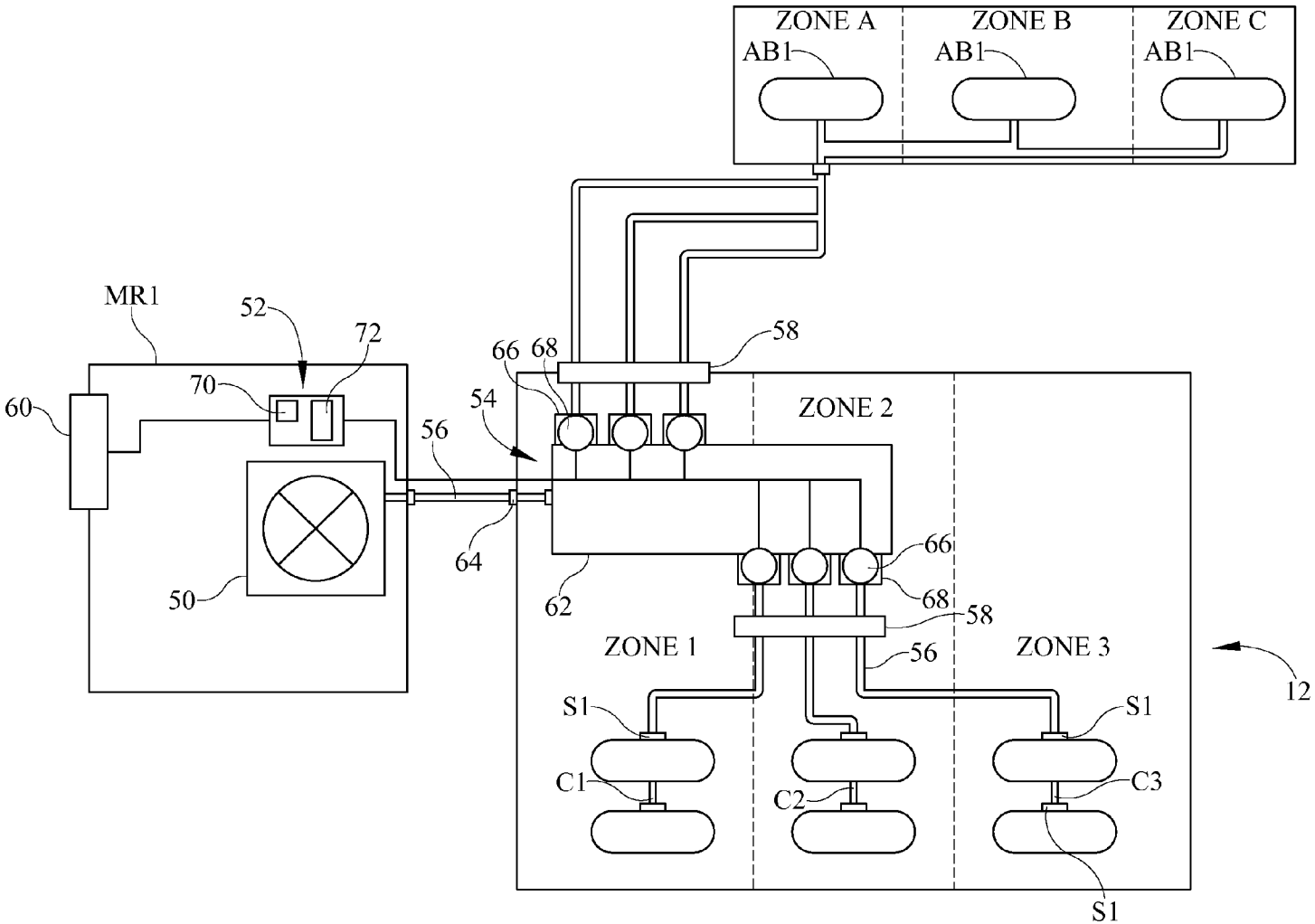
FIG. 8 is a diagrammatic view of the gas supply system of FIG. 1 according to another illustrative embodiment, wherein the controller and the gas supply are positioned within a mattress replacement control box.
Figure 9:
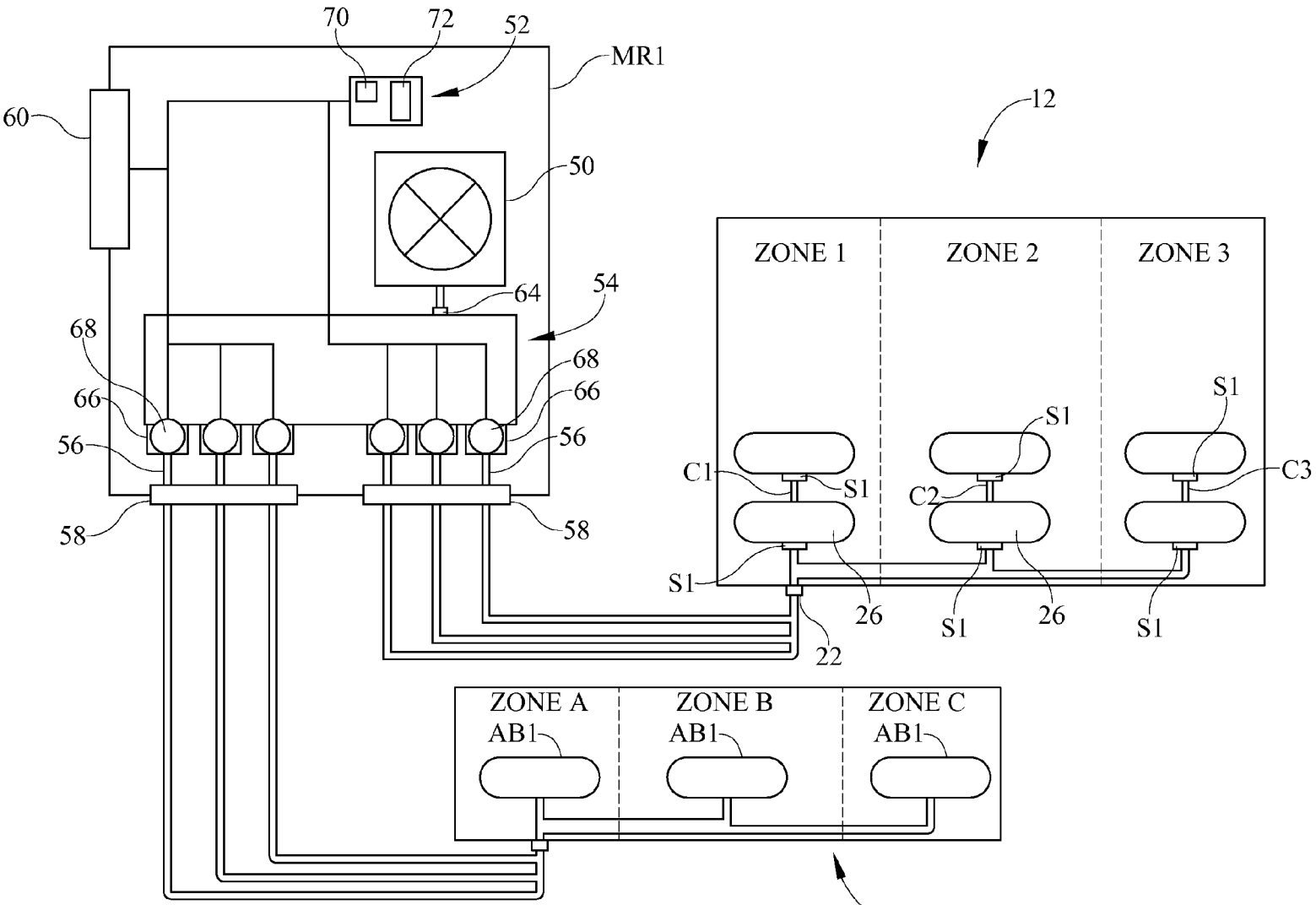
FIG. 9 is a diagrammatic view of the gas supply system of FIG. 8 according to another illustrative embodiment, wherein the connectors are coupled to the mattress control box.
Figure 10:
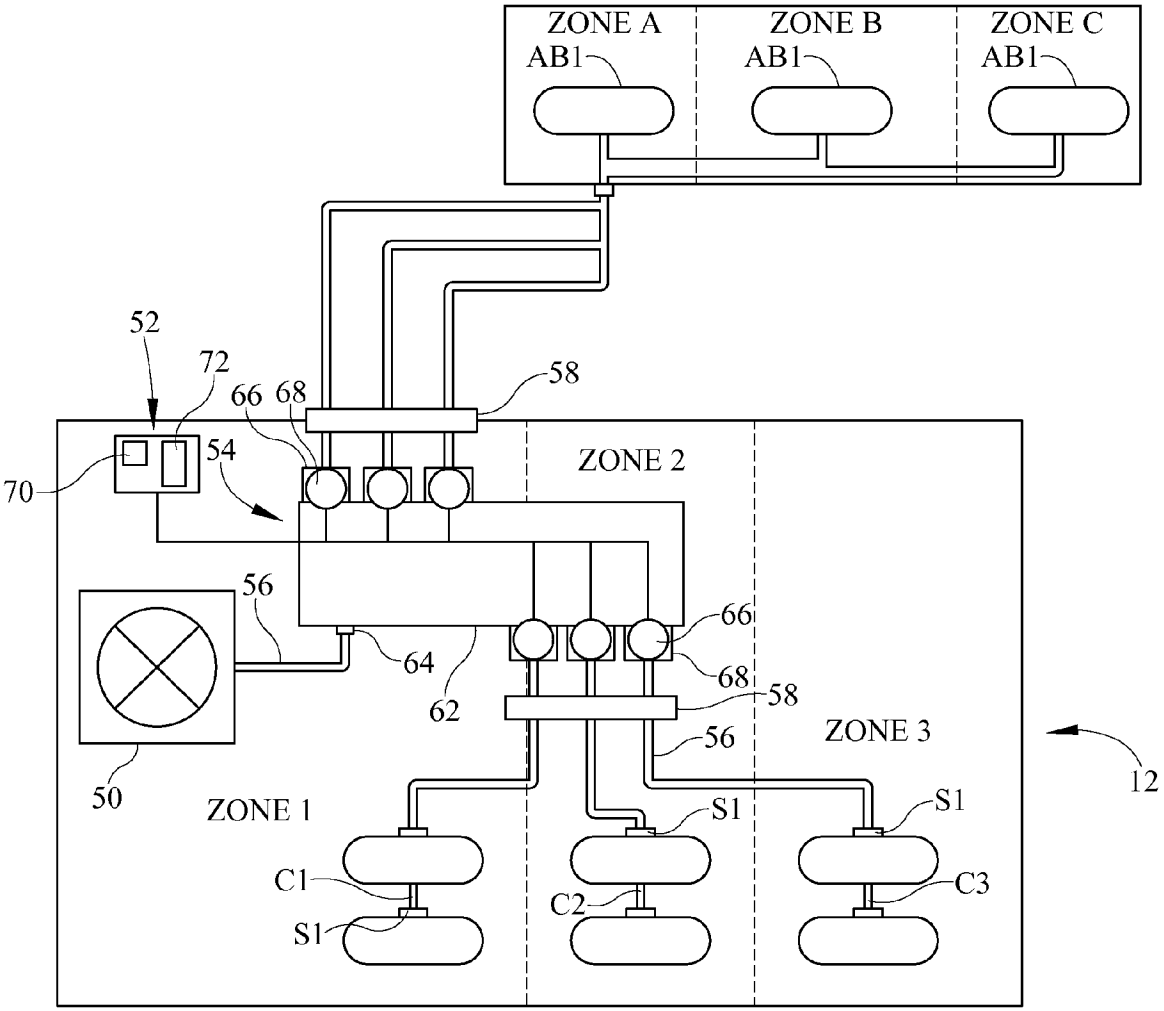
FIG. 10 is a diagrammatic view of the gas supply system of FIG. 1 according to another illustrative embodiment, wherein the connector is coupled to the person-support surface.
Figure 13:
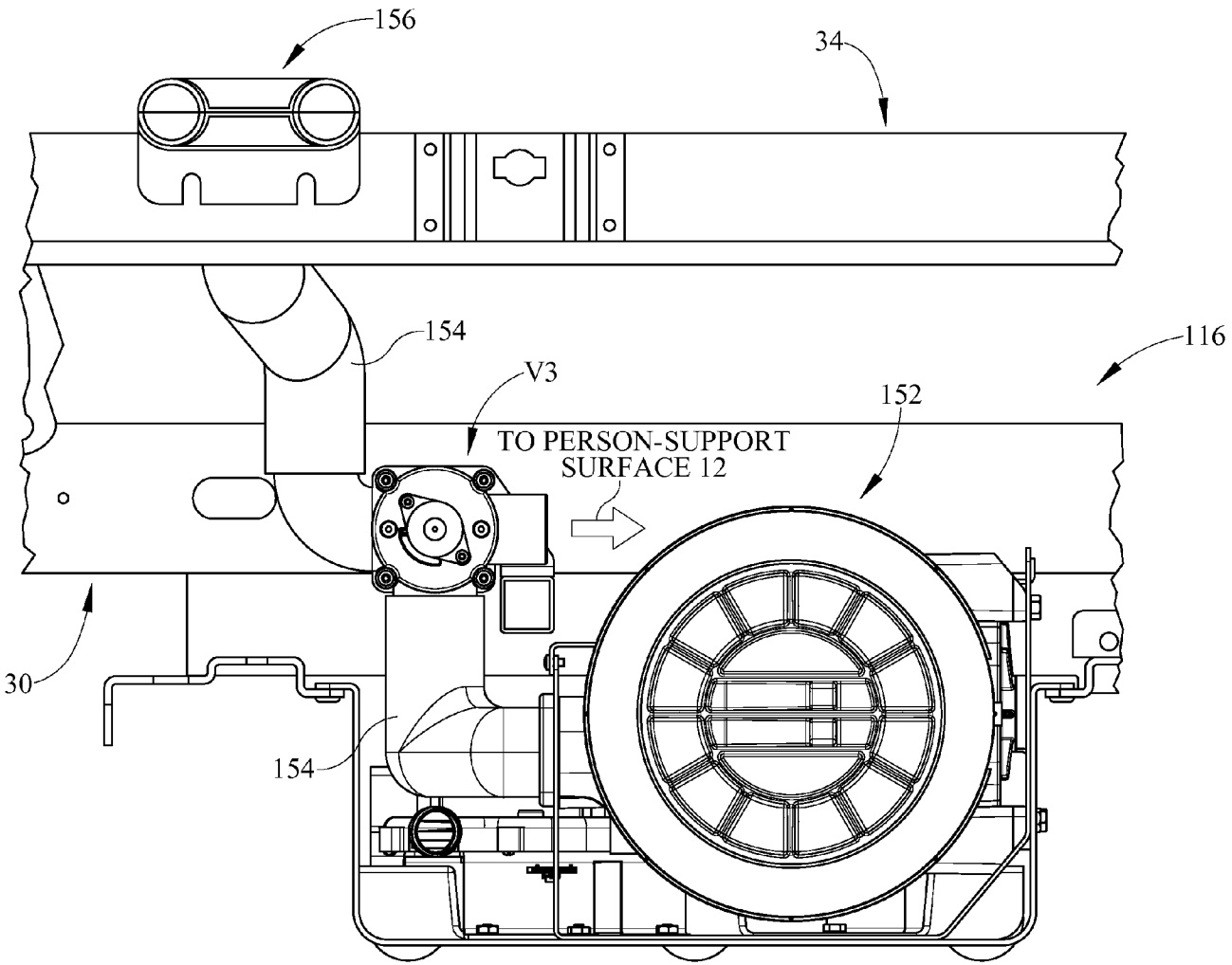
FIG. 13 is a side view of the gas supply assembly of the gas supply system of FIG. 12 according to one illustrative embodiment.

The connector 58 can be configured to removably couple the pneumatic device 14 to the gas supply assembly 16 as shown in FIGS. 1 and 6-10. In one illustrative embodiment, the connector 58 can be a receptacle that can be configured to removably retain the therapy connector TC1 therein and can be in fluid communication with the manifold assembly 54 via one of the plurality of conduits 56. It should be appreciated that the connector 58 can be received by the therapy connector TC1. It should also be appreciated that the connector 58 can include a valve (not shown) configured to prevent fluid from escaping from the connector 58 when the therapy connector 58 is not coupled to the connector 58. In one illustrative embodiment, the connector 58 can be positioned on the person-support surface 12 as shown in FIG. 10. In another illustrative embodiment, the connector 58 can be positioned on the person-support apparatus 28 as shown in FIG. 13. In yet another illustrative embodiment, the connector 58 can be positioned on the mattress replacement system control box MR1 as shown in FIGS. 8-9.

The components of the gas supply assembly 16 can be co-located or separated depending on the configuration of the gas supply system 10. In one illustrative embodiment, the components of the gas supply assembly 16 can be coupled to the lower frame 30 and the upper frame 32 as shown in FIG. 13. In another illustrative embodiment, the components of the gas supply assembly 16 can be positioned within the person-support surface 12 as shown in FIG. 10. In another illustrative embodiment, the gas supply 50 and the controller 52 can be positioned in a mattress replacement system control box MR1 and the manifold assembly 54 can be positioned in the person-support surface 12 as shown in FIG. 8. It should be appreciated that the manifold assembly 54 can be positioned in the mattress replacement system (MRS) control box MR1 or can be located on the person-support apparatus 28 as shown in FIGS. 8-9. It should be appreciated that the MRS control box MR1 can include a user interface 60 coupled thereto. It should also be appreciated that the user interface 60 of the MRS control box MR1, a user interface 42 on the person-support apparatus 28, and/or a remote user interface or terminal (not shown) can be configured to control the gas supply assembly 16 in accordance with an input signal.

The gas supply 50 can be in fluid communication with the manifold assembly 54 via at least one of the plurality of conduits 56 as show in FIGS. 1 and 6-10. The gas supply 50 can be configured to communicate a gas at various pressures and rates depending on the pneumatic device 14. For example, if the pneumatic device 14 is the chest-wall oscillation device 14, the gas supply 50 can be a gas blower configured to communicate a gas at a relatively low pressure and a relatively high flow rate. In another example, if the pneumatic device 14 is a compression therapy garment, the gas supply 50 can be a gas compressor configured to communicate gas at a relatively low flow rate and a relatively high pressure. It should also be appreciated that the gas supply 50 can be configured to communicate a gas to, for example, at least two of the compression therapy garment 14 and the chest wall oscillation device 14, and/or another pneumatic device 14. It should also be appreciated that the gas supply 50 can be configured to modify the temperature and/or humidity of the gas being supplied.

The manifold assembly 54 can be in fluid communication with the gas supply 50, the person-support surface 12, and the connector 58 via the plurality of conduits 56. In one illustrative embodiment, the manifold assembly 54 can include a housing 62 with an inlet 64 and a plurality of outlets 66 as shown in FIGS. 1 and 6-10. The housing 62 can include a first portion P1, a second portion P2, and a partition P3 configured to regulate communication of fluid between the first portion P1 and the second portion P2 as shown in FIGS. 1 and 8-10. The first portion P1 can be configured to contain a gas at a first pressure that can be communicated to the person-support surface 12. The second portion P2 can be configured to contain a gas at a second pressure that can be communicated to the pneumatic device 14. It should be appreciated that the first pressure and the second pressure can be substantially equal.

In another illustrative embodiment, the manifold assembly 54 can include a housing 62*a* with an inlet 64*a* and a plurality of outlets 66*a* that can be dedicated to the person-support surface 12 and a housing 62*b* with an inlet 64*b* and a plurality of outlets 66*b* that can be dedicated to the pneumatic device 14 as shown in FIGS. 6-7. The gas supply 50 can be in fluid communication with the housing 62*a* via a first conduit 56*a* and in fluid communication with the housing 62*b* via a second conduit 56*b*. It should also be appreciated that the conduit 56*a* and conduit 56*b* can have different diameters and/or can have fittings or valves V1 and V2 coupled thereto to control the flow of gas to the housing 62*a* and the housing 62*b*, respectively, to make the gas flow rate between conduit 56*a* and conduit 56*b* proportional as shown in FIG. 7.

The outlets 66 can be in fluid communication with the person-support surface 12 and/or the connector 58 via one of the plurality of conduits 56 as shown in FIGS. 1 and 6-10. The outlets 66 can include a valve 68 therein configured to regulate the flow of gas from the housing 62 to the person-support surface 12 and/or the connector 58. The valves 68 can be configured to be actuated by the controller 52. It should be appreciated that the valves 68 can be actuated individually and/or in groups simultaneously and/or sequentially. It should also be appreciated that the valves 68 can be partially actuated by the controller 52 to vary the gas flow rate.

The controller 52 can be configured to actuate the valves 68 to control the timing and/or the amount of gas communicated to the person-support surface 12 and/or the pneumatic device 14. It should be appreciated that there can be two controllers 52*a* and 52*b* with controller 52*a* being configured to control the timing and/or the amount of gas communicated to the person-support surface 12, and controller 52*b* being configured to control the timing and/or the amount of gas communicated to the pneumatic device 14 as shown in FIG. 1. It should also be appreciated that the controller 52*b* can be provided in an upgrade kit along with a second manifold assembly 54*b*, the connector 58, and a plurality of conduits 56. The controller 52 can be in communication with the user interface 42 and can actuate the valves 68 in accordance with a user input signal from the user interface 42.

Figure 11:
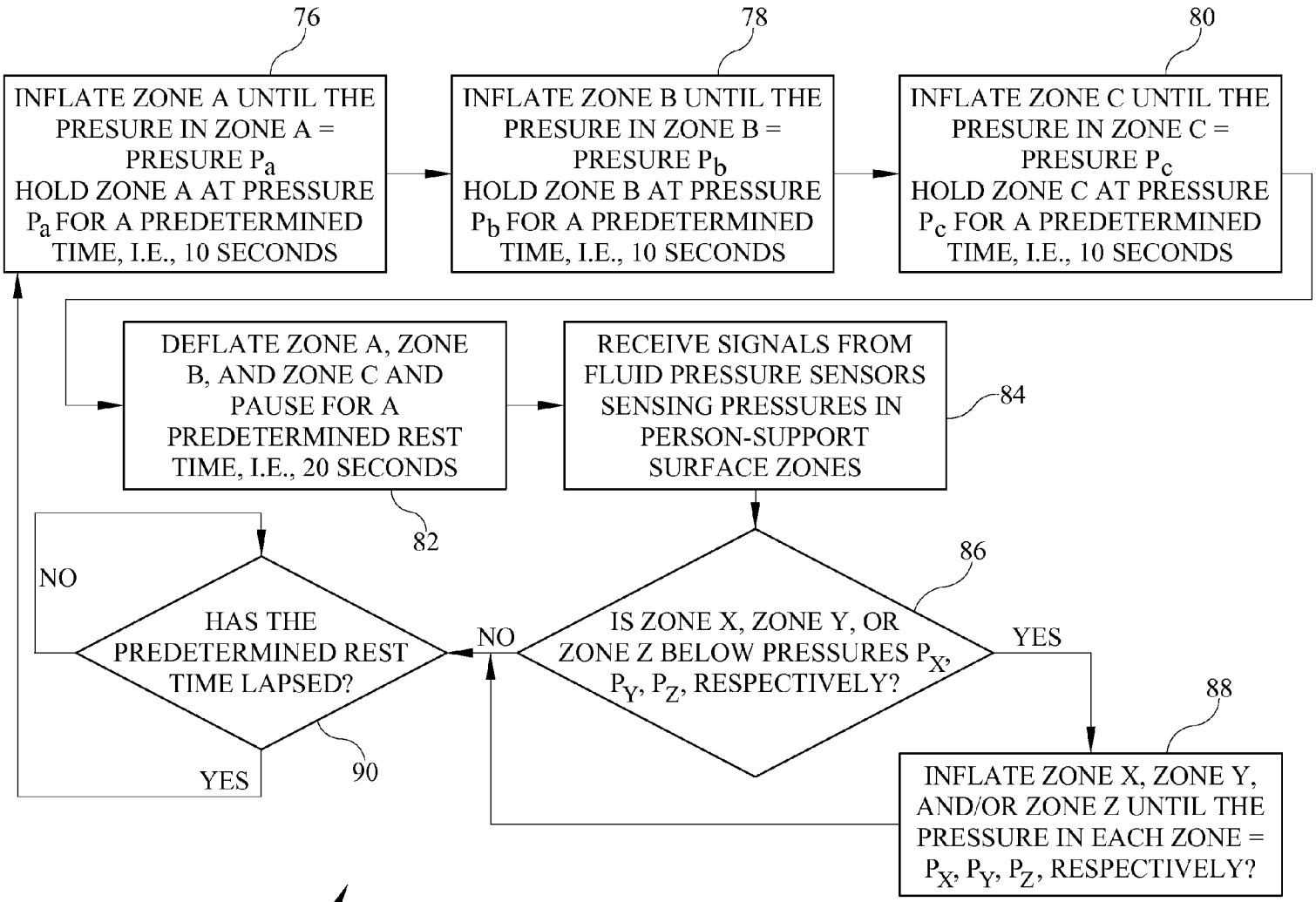
FIG. 11 is a flow chart showing the operation of the gas supply system according to one illustrative embodiment.

The controller 52 can include a processor 70 and memory 72 electrically coupled to the processor 70 as shown in FIGS. 1 and 6-10. The memory 72 can be configured to store instructions 74 that can be executed by the processor 70. The instructions 74 can cause the controller 52 to actuate at least one of the valves 68 to allow a gas to be communicated to at least one of the person-support surface 12 and the pneumatic device 14. The instructions 74 can vary depending on the number of manifold assemblies 54, the size of the gas supply 50, whether there are multiple fluid supplies 50, or other variables. In one illustrative embodiment, there is only one gas supply 50 and the instructions 74 can be configured to prioritize which of the person-support surface 12 and the pneumatic device 14 has a gas communicated to it. In one example, prioritization can occur when a compression therapy cycle is in progress. In this example, the instructions 74 can include operations/conditionals 76, 78, 80, 82, 84, 86, and 88 in FIG. 11. In operation 76 the controller 52 can inflate Zone A of the pneumatic device 14 by actuating a valve 68*a* and allow a gas to be communicated to Zone A until the pressure in Zone A has reached a pressure $P_a$. The controller 52 can maintain the pressure within Zone A for a predetermined amount of time, for example, 10 seconds.

In operation 78, the controller 52 can inflate Zone B by actuating a valve 68*b* and allow a gas to be communicated to Zone B until the pressure in Zone B has reached a pressure $P_b$. The controller 52 can maintain the pressure within Zone B for a predetermined time, such as, 10 seconds. It should be appreciated that the actuation of valve 68*b* and valve 68*a* can overlap so that a gas can be simultaneously communicated to Zone B and Zone A, respectively.

In operation 80, the controller 52 can inflate Zone C by actuating a valve 68*c* to allow a gas to be communicated to Zone C until the pressure in Zone C has reached a pressure $P_c$. The controller 52 can maintain the pressure within Zone C for a predetermined time, such as, 10 seconds.

In operation 82, the controller 52 can actuate the valves $\mathbf{68}_a$-$\mathbf{68}_c$. to deflate Zone A, Zone B, and Zone C. Once Zone A, Zone B, and Zone C are deflated, the controller 52 can maintain Zone A, Zone B, and Zone C in the deflated state for a predetermined rest time, such as, for example, 20 seconds.

During the predetermined rest time, the controller can proceed to operation 84 where the controller 52 can receive input signals from the sensors S1 corresponding to the gas pressure in Zone X, Zone Y, and Zone Z.

In conditional 86, the controller 52 can compare the pressure in Zone X, Zone Y, and Zone Z to predetermined pressure thresholds $P_x$, $P_y$, and $P_z$. If the gas pressure in Zone X, Zone Y, and Zone Z are below the predetermined thresholds $P_x$, $P_y$, and $P_z$, the controller 52 can proceed to operation 88 where the controller 52 can actuate the surface valves 68 to allow a gas to be communicated to the zone(s) below the predetermined thresholds until the gas pressure in the zones meets the predetermined pressure threshold. If the gas pressure in Zone X, Zone Y, and Zone Z are at or above the predetermined thresholds $P_x$, $P_y$, and $P_z$, the controller 52 can proceed to operation 76. It should be appreciated that if the gas pressure in Zone X, Zone Y, and/or Zone Z is above the predetermined thresholds $P_x$, $P_y$, and $P_z$, a relief valve (not shown) can be actuated to reduce the pressure to the predetermined threshold.

In operation 88, the controller 52 can determine if the predetermined rest time has lapsed. If the predetermined rest time has lapsed, the controller 52 can return to operation 76. If the predetermined rest time has not lapsed, then the controller 52 can continue to maintain Zone A, Zone B, and Zone C in the deflated state until the predetermined rest time has lapsed.

A gas supply system 110 according to another illustrative embodiment of the current disclosure is shown in FIG. 12-16, wherein like reference numerals indicate like features previously described. The gas supply system 110 can include a person-support surface 12, a pneumatic device 14 external to the person-support surface 12, and a gas supply assembly 116. In one illustrative embodiment, the gas supply assembly 116 can be coupled to the frame 29 as shown in FIG. 13.

Figure 12:
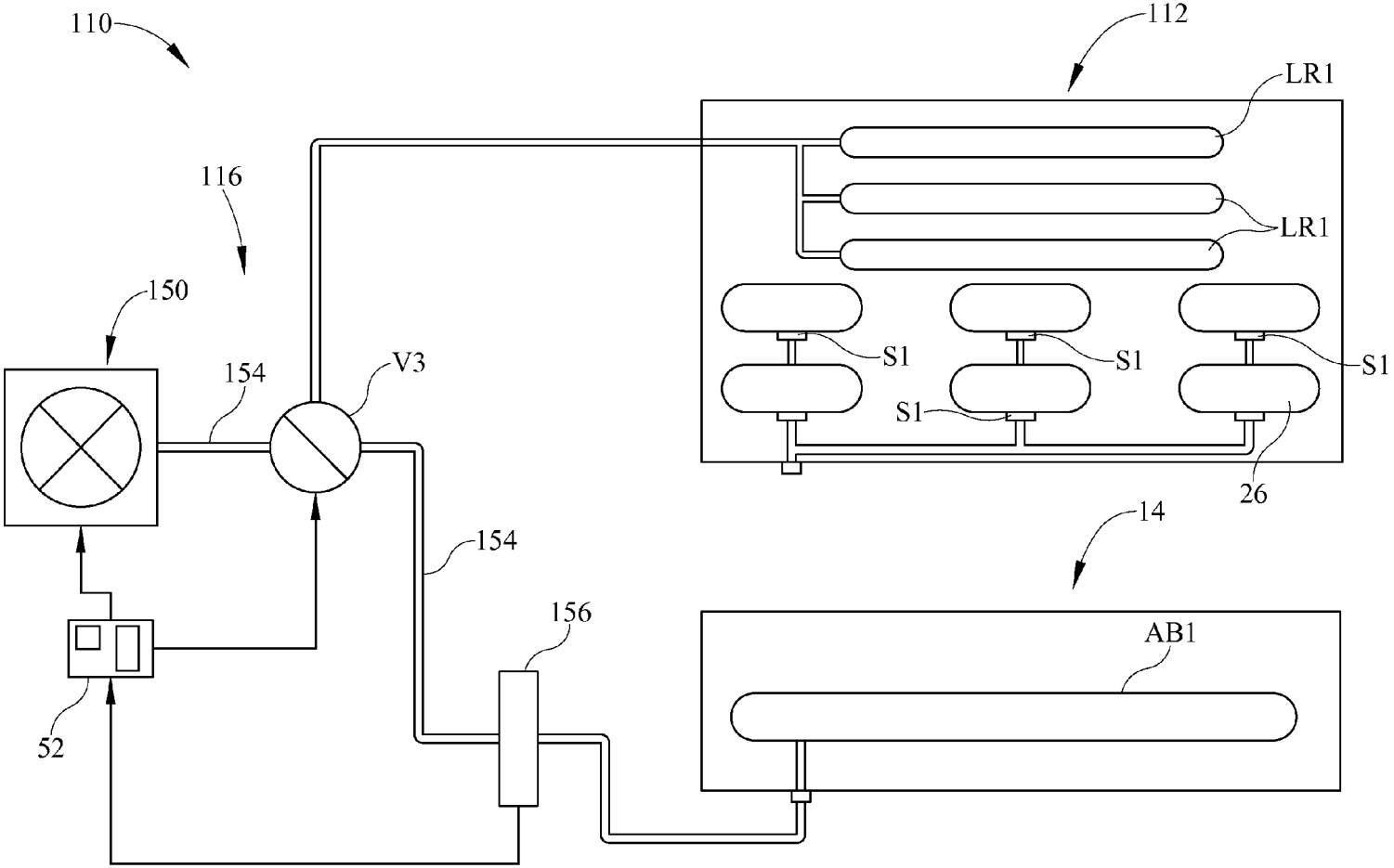
FIG. 12 is a diagrammatic view of a gas supply system according to another illustrative embodiment.
Figure 14:
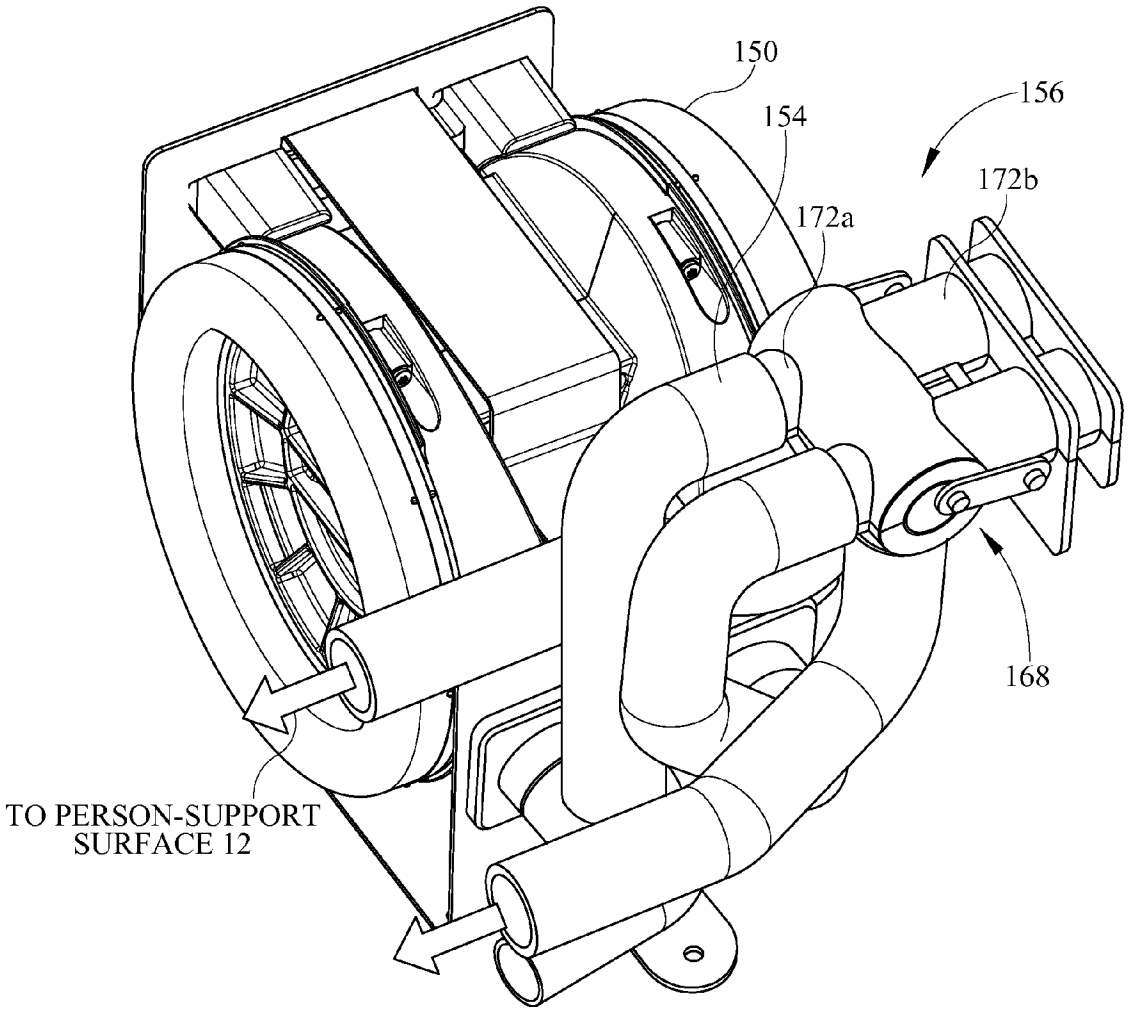
FIG. 14 is a top perspective view of the gas supply assembly of the gas supply system of FIG. 12 according to one illustrative embodiment.

The gas supply assembly 116 can include a gas supply 150, a controller 52, a conduit 154, and a connector 156. The gas supply 150 can be coupled to the connector 156 by the conduit 154 as shown in FIGS. 12-14. The connector 156 can be configured to direct the flow of gas to the person-support surface 12 when the pneumatic device 14 is not connected to the connector 156, and direct the flow of gas to the pneumatic device 14 when the pneumatic device is connected to the connector 156. In one illustrative embodiment, the connector 156 can be configured to direct the flow of gas to a plurality of lateral rotation bladders LR1 positioned in the person-support surface 12 when the pneumatic device 14 is not connected to the connector 156, and direct the flow of gas to the pneumatic device 14 when the pneumatic device 14 is connected to the connector 156. In another illustrative embodiment, the connector 156 can be configured to direct the flow of gas to a plurality of percussion vibration bladders (not shown) positioned in the person-support surface 12 when the pneumatic device 14 is not connected to the connector 156, and direct the flow of gas to the pneumatic device 14 when the pneumatic device 14 is connected to the connector 156. It should be appreciated that the gas supply assembly 116 can include a valve V3 positioned between the gas supply 150 and the connector 156 that can be configured to direct the flow of gas to the connector 156 and/or the person-support apparatus 28 in response to the pneumatic device 14 being coupled to the connector 156 as shown in FIG. 12. It should also be appreciated that valve V3 can be actuated mechanically by a mechanism (not shown) coupled to the connector 156 and configured to actuate the valve when the pneumatic device 14 is coupled to the connector. It should also be appreciated that the valve V3 can be electronically actuated by the controller 52 in response to an input signal from an electronic device (not shown), such as, a relay or sensor, configured to indicate when the pneumatic device 14 is coupled to the connector 156. It should also be appreciated that the capacity of the gas supply 150 could be sufficient to simultaneously direct the flow of gas to the pneumatic device 14 and the person-support surface 12.

Figure 15:
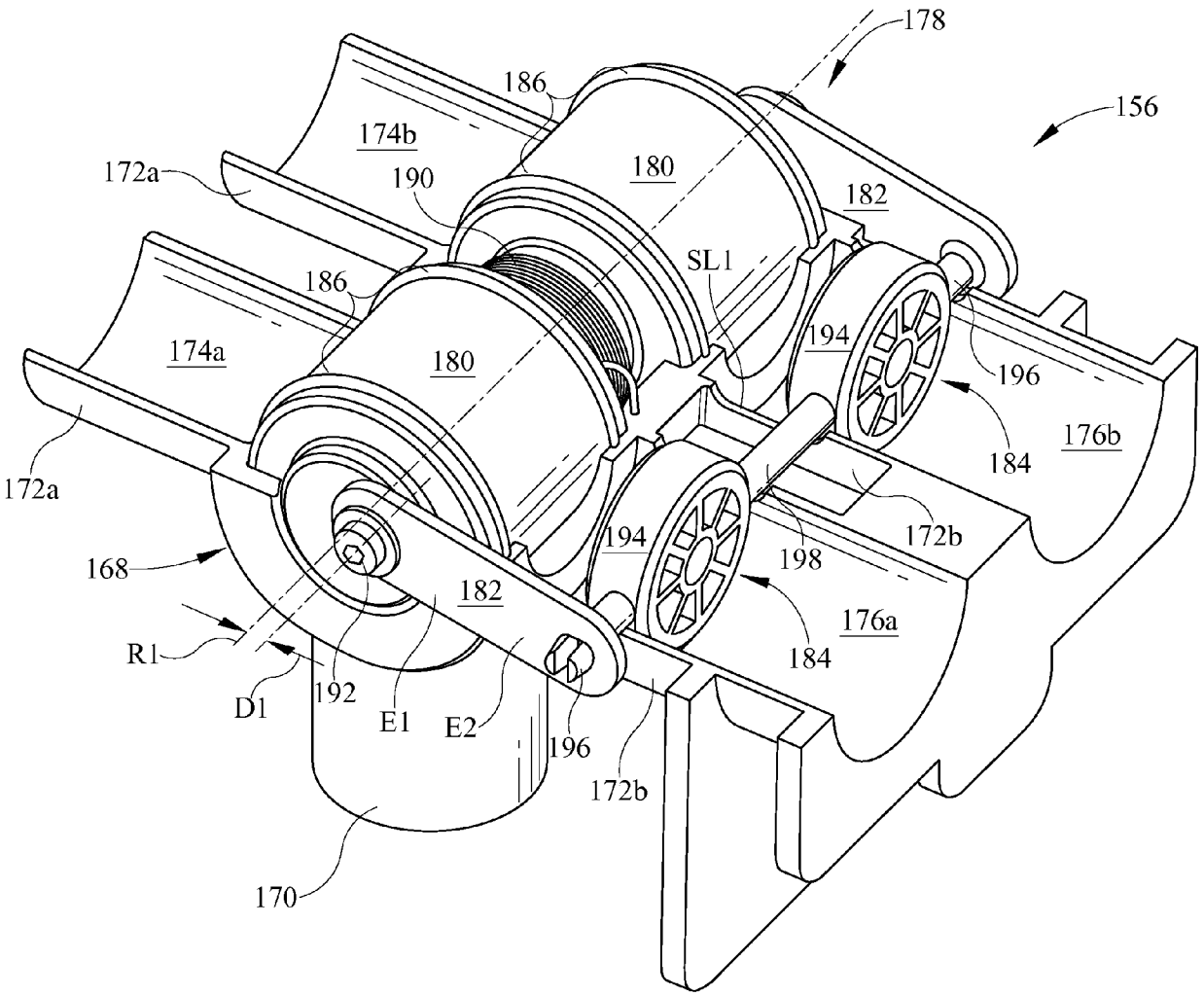
FIG. 15 is a side perspective view of the connector of the gas supply assembly of FIG. 14 with the plungers in a first position.
Figure 16:
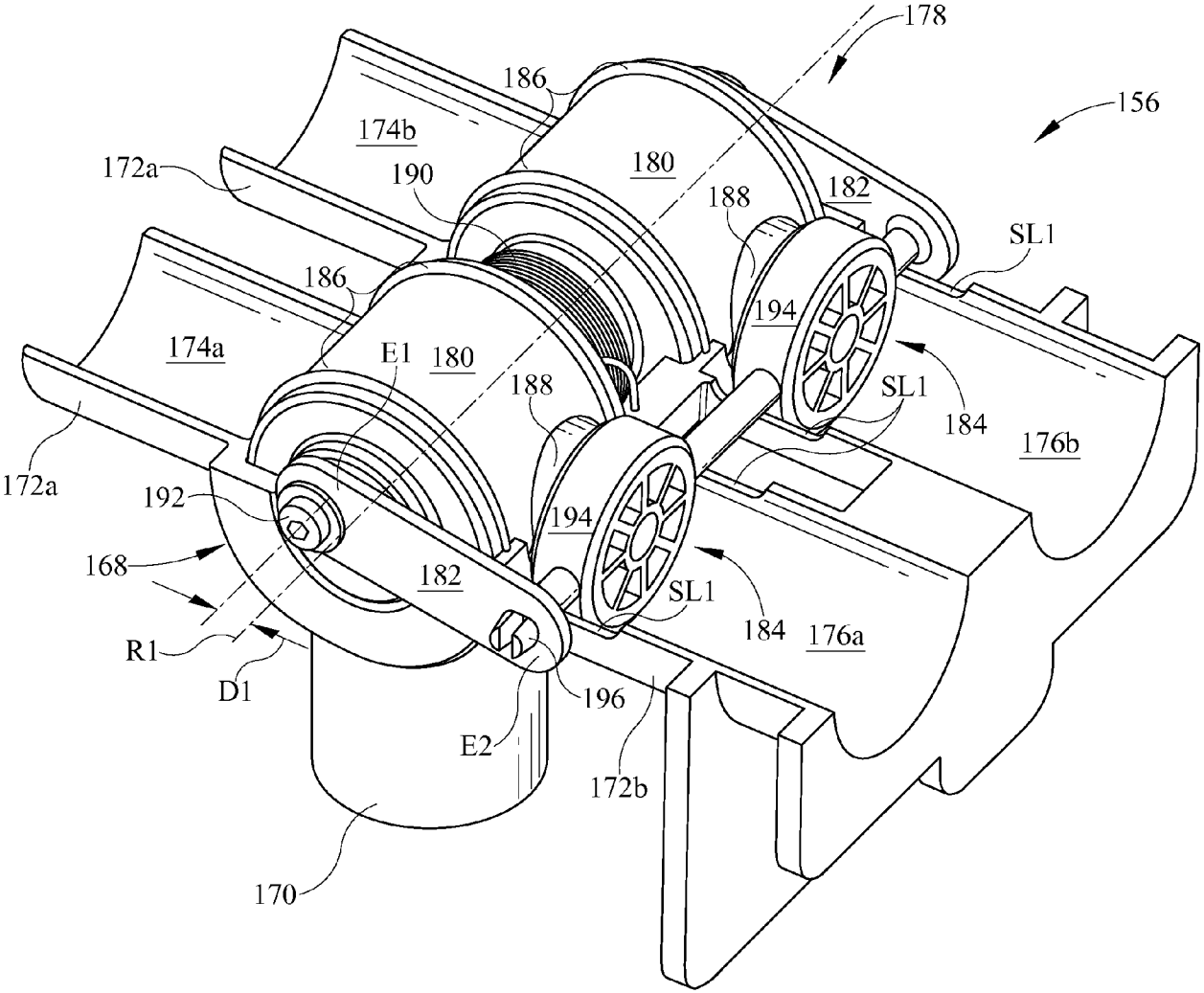
FIG. 16 is a side perspective view of the connector of the gas supply assembly of FIG. 14 with the plungers in a second position.

The connector 156 can be coupled to the person-support apparatus 28 and can be configured to removably couple with the pneumatic device 14. In one illustrative embodiment, the connector 156 can include a housing 168, an inlet 170, a first outlet 172*a*, and a second outlet 172*b* as shown in FIG. 13. In another illustrative embodiment, the connector 156 can include a housing 168, an inlet 170, a first outlet 172*a*, a second outlet 172*b*, and a valve mechanism 178 as shown in FIGS. 14-16. With respect to the second illustrative embodiment, the first outlet 172*a* can be configured to direct the flow of gas to the person-support surface 12 when the pneumatic device 14 is not connected to the connector 158, and the second outlet 172*b* can be configured to direct the flow of gas to the pneumatic device 14 when the pneumatic device is connected to the connector 158 as shown in FIGS. 15-16. The first outlet 172*a* can include a first outlet bore 174*a* and a second inlet bore 174*b*, and the second outlet 172*b* can include a first outlet bore 176*a*, a second outlet bore 176*b*, and a plurality of slots SL1. The second outlet 172*b* and can be configured to receive and removably retain the therapy connector TC1 of the pneumatic device 14 therein.

The valve mechanism 178 can be configured to selectively allow gas to be communicated through the connector 158 when the pneumatic device 14 is coupled thereto. The valve mechanism 178 can include a valve cylinder 180, a plurality of links 182, and a plunger assembly 184 as shown in FIGS. 15-16. The valve cylinder 180 can be positioned within the housing 168 and can be configured to rotate about a rotational axis R1 with respect to the housing 168 between a first position and a second position. The valve cylinder 180 can include a plurality of seals 186, a plurality of openings 188, and a return spring 190. The seals 186 can extend around the circumference of the valve cylinder 180 and can be configured to cooperate with the housing 168 and the cylinder to help prevent gas from escaping from the connector 158. It should be appreciated that a portion of the seals 186 can be positioned in grooves (not shown) recessed in the valve cylinder 180 that can be configured to locate the seals 186 on the valve cylinder 180. The plurality of openings 188 in the valve cylinder 180 can be configured to connect the inlet 170 and the outlet 174 when the valve cylinder is in the second position. The return spring 190 can be coupled to the housing 168 and can wrap around a portion of the valve cylinder 180. The return spring 190 can be configured to rotate the valve cylinder 180 from the second position to the first position and/or maintain the valve cylinder 180 in the first position when the pneumatic device 14 is not coupled to the connector 158.

The links 182 can be movably coupled to the valve cylinder 180 and the plunger assembly 184 and can be positioned outside the housing 168 as shown in FIGS. 15-16. The links can be configured to rotate the valve cylinder 180 about the rotational axis R1 as the plunger assembly 184 is moved with respect to the housing 168. In one illustrative embodiment, a first end E1 of the links 182 can be coupled to the valve cylinder 180 at a joint 192. The joint 192 can be spaced a distance D1 from the rotational axis R1.

The plunger assembly 184 can be positioned within the outlet 174 and can be configured to engage the therapy connector TC1 and move within the outlet 174 to actuate the valve mechanism 178 when the therapy connector TC1 is coupled to the connector 158. The plunger assembly 184 can include a plurality of plungers 194 and a plurality of link ends 196 as shown in FIGS. 15-16. The plungers 194 can be positioned within the first outlet bore 176*a* and the second outlet bore 176*b* and can be configured to slide within the outlet between a first plunger position and a second plunger position. In one illustrative embodiment, the plungers 194 can be cylindrically shaped and can be connected together by a plunger connector 198 extending therebetween. It should be appreciated that the plunger connector 198 can extend through the slots SL1 between the first outlet bore 176*a* and the second outlet bore 176*b*. The link ends 196 can be coupled to the plungers 194 and can extend out of the first outlet bore 176*a* and the second outlet bore 176*b* through the slots SL1 to couple with the links 182.

In operation, the valve 156 can be initially configured to communicate a gas from the pneumatic supply 150 to the person-support surface 12 when the pneumatic device 14 is not coupled to the connector 158. When the therapy connector TC1 of the pneumatic device 14 is inserted into the first outlet bore 176*a* and the second outlet bore 176*b* of the connector 158, the therapy connector TC1 can engage the plungers 194 and move the plungers 194 in the first outlet bore 176*a* and the second outlet bore 176*b* from the first plunger position to the second plunger position. As the plungers 194 are moved the links 182 cause the valve cylinder 180 to rotate about the rotational axis R1 and cause the flow of gas to be directed to the pneumatic device 14. When the therapy connector TC1 is disconnected from the connector 158, the return spring 190 causes the valve cylinder 180 to rotate about the rotational axis R1. The rotation of the valve cylinder 180 causes the links 182 to move the plungers 194 to the second plunger position to the first plunger position and causes the flow of gas to be directed to the person-support surface 12.

Figure 17:
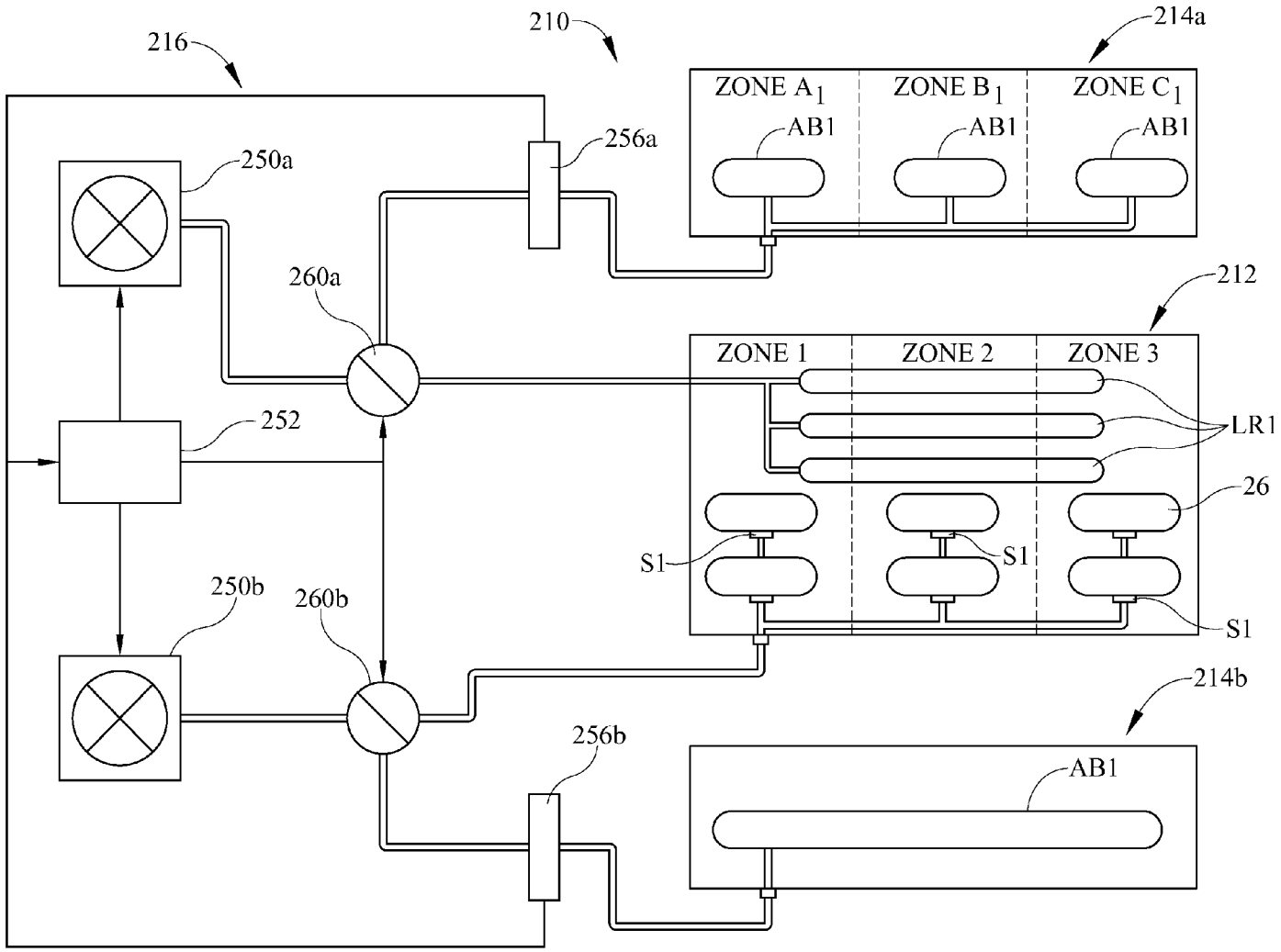
FIG. 17 is a diagrammatic view of a gas supply system according to yet another illustrative embodiment

A gas supply system 210 according to another illustrative embodiment of the current disclosure is shown in FIG. 17. The gas supply system 210 can include a person-support surface 212, a first pneumatic device 214*a* and a second pneumatic device 214*b* external to the person-support surface 212, and a gas supply assembly 216. In one illustrative embodiment, the first pneumatic device 214*a* can be a chest wall oscillation therapy garment or vest and the second pneumatic device 214*b* can be a sequential compression device as previously described. It should be appreciated that the pneumatic device 214 can be configured to be identified mechanically and/or electrically by the controller 250 through the connector 156 so that the controller 250 can control the gas supply assembly 216 as a function of one or more characteristics of the pneumatic device 214. It should also be appreciated that the pneumatic device 214 can be mechanically identified based on, for example, the physical configuration of the therapy connector TC1 and/or the connector 156 and how they couple to one-another. It should also be appreciated that the pneumatic device 214 can be electrically identified using, for example, a magnet on the therapy connector TC1 and a magnet on the connector 156 to produce the Hall effect. It should also be appreciated that the pneumatic device 214 can be electrically identified using, for example, a specific resistor value for each type of pneumatic device 21, i.e., one value for chest wall oscillation devices, another value for sequential compression devices, and yet another for a surgical device.

The gas supply assembly 116 can include a first gas supply 250*a*, a second gas supply 250*b*, a controller 252, a first connector 258*a*, a second connector 258*b*, and a plurality of conduits 56 as shown in FIG. 17. In one illustrative embodiment, the first gas supply 250*a* can be a gas compressor and the second gas supply 250*b* can be a gas blower. It should be appreciated that the gas supply assembly 216 can include only one gas supply 258 with sufficient capacity to satisfy the demands of the gas supply assembly 216. The first gas supply 250*a* can be coupled to a first valve 260*a* via a conduit 56 and the second gas supply 250*b* can be coupled to a second valve 260*b* via a conduit 56. The first connector 256*a* and the second connector 256*b* can be configured to operate like the connectors 56, 156 previously described. In one illustrative embodiment, the first connector 256*a* can be configured to couple to the first pneumatic device 214*a* and the second connector 256*b* can be configured to couple to the second pneumatic device 214*b*. It should be appreciated that either connector can be configured to couple to either pneumatic device.

The controller 252 can be configured to control the gas supply assembly 216 in various ways depending on whether the first pneumatic device 214*a* and/or the second pneumatic device 214*b* is coupled to the first connector 256*a* and/or the second connector 256*b*, respectively, as shown in FIG. 17. It should be appreciated that the first pneumatic device 214*a* and the second pneumatic device 214*b* can be coupled to either of the first connector 256*a* and 256*b*. In one illustrative embodiment, when the first pneumatic device 214*a* is coupled to the first connector 256*a*, the controller 252 can actuate the first valve 260*a* to direct the flow of gas from lateral rotation bladders LR1 in the person-support surface 212 to the first pneumatic device 214*a*. It should be appreciated that if the first gas supply 250*a* is not active when the first pneumatic device 214*a* is coupled to the first connector 256*a*, the controller 252 will activate it. It should also be appreciated that gas can be supplied to both the lateral rotation bladders LR1 and the first pneumatic device 214*a* depending on the capacity of the fluid supply 256*a*. It should also be appreciated that the second connector 256*b* can direct the flow of gas from the second gas supply 250*b* to the gas bladders 26 in the person-support surface 212 while the first gas supply 250*a* communicates a gas to the first pneumatic device 214*a* coupled to the first connector 256*a*.

In another illustrative embodiment, when the second pneumatic device 214*b* is coupled to the second connector 256*b*, the controller 252 can actuate the second valve 260*b* to direct the flow of gas from the gas bladders 26 in the person-support surface 212 to the second pneumatic device 214*b*. It should be appreciated that if the first gas supply 250*a* is not active when the second pneumatic device 214*b* is coupled to the second connector 256*b*, the controller 252 will activate it. It should also be appreciated that gas can be supplied to both the gas bladders 26 and the second pneumatic device 214*b* depending on the capacity of the fluid supply 256*b*.

Many other embodiments of the present disclosure are also envisioned. For example, a gas supply system comprises a person-support surface, a garment, and a gas supply. The person-support surface includes a chamber configured to contain a gas therein. The garment includes a chamber configured to contain a gas therein. The gas supply is configured to supply a gas to both the garment and the person-support surface.

In another example, a method comprises: actuating a valve assembly to communicate a gas from a gas supply to a garment at a first gas flow rate to maintain a first chamber of the garment configured to contain a gas therein at a first pressure for a first period of time; actuating the valve assembly to communicate a gas from the gas supply to the garment at a second gas flow rate to maintain the first chamber at a second pressure for a second period of time, the first gas flow rate being greater than the second gas flow rate; sensing a gas pressure in a second chamber of a person-support surface configured to contain a gas therein; and actuating the valve assembly to communicate a gas from the gas supply to the second chamber at a third gas flow rate to maintain the pressure within the second chamber at a third pressure.

In yet another example, a gas supply system comprises a person-support surface, a microclimate management topper, a pneumatic device, and a gas supply. The person-support surface includes a chamber configured to contain a gas. The microclimate management topper is configured to be positioned on the person-support surface. The gas supply is configured to supply a gas to the pneumatic device and at least one of the person-support surface and the microclimate management topper.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A gas supply system, comprising:

a mattress including a chamber configured to contain a gas therein;

a garment including a chamber configured to contain a gas therein; and a gas supply being coupled simultaneously via a pneumatic circuit to both the garment and the mattress and operating to supply a gas simultaneously to both the garment and the mattress.

2. The gas supply system of claim 1, wherein the garment is configured to substantially surround a portion of a person.

3. The gas supply system of claim 1, wherein the garment is configured to provide chest wall oscillation therapy.

4. The gas supply system of claim 1, wherein the garment is configured to provide sequential compression therapy.

5. The gas supply system of claim 1, wherein the garment is configured to provide percussion/vibration therapy.

6. The gas supply system of claim 1, wherein the gas supply is a gas blower.

7. The gas supply system of claim 1, wherein the gas supply is a compressor.

8. The gas supply system of claim 1 further comprising a valve assembly in fluid communication with the gas supply, the garment, and the mattress, the valve assembly configured to selectively communicate a gas from the gas supply to one of the garment and the mattress.

9. The gas supply system of claim 8, wherein the valve assembly includes a valve and a first connector in fluid communication with the valve, the garment being configured to removably couple to the first connector.

10. The gas supply system of claim 9, wherein the first connector is coupled to the mattress.

11. A gas supply system, comprising:

a mattress including a chamber configured to contain a gas therein;

a garment including a chamber configured to contain a gas therein;

a gas supply configured to supply a gas to both the garment and the mattress; and a valve assembly in fluid communication with the gas supply, the garment, and the mattress, the valve assembly configured to selectively communicate a gas from the gas supply to one of the garment and the mattress;

wherein the valve assembly includes a valve and a first connector in fluid communication with the valve, the garment being configured to removably couple to the first connector;

wherein the mattress is supported on a frame and the first connector is coupled to the frame.

12. The gas supply system of claim 9, wherein the valve is configured to direct gas from the gas supply to the garment when the garment is coupled to the first connector.

13. A gas supply system, comprising:

a mattress including a chamber configured to contain a gas therein;

a garment including a chamber configured to contain a gas therein;

a gas supply configured to supply a gas to both the garment and the mattress; and a valve assembly in fluid communication with the gas supply, the garment, and the mattress, the valve assembly configured to selectively communicate a gas from the gas supply to one of the garment and the mattress;

wherein the valve assembly includes a valve and a first connector in fluid communication with the valve, the garment being configured to removably couple to the first connector;

wherein the gas supply and the valve are positioned within the mattress.

14. A gas supply system, comprising:

a mattress including a chamber configured to contain a gas therein;

a garment including a chamber configured to contain a gas therein;

a gas supply configured to supply a gas to both the garment and the mattress; and a valve assembly in fluid communication with the gas supply, the garment, and the mattress, the valve assembly configured to selectively communicate a gas from the gas supply to one of the garment and the mattress;

wherein the valve assembly includes a valve and a first connector in fluid communication with the valve, the garment being configured to removably couple to the first connector;

wherein the gas supply, the valve, and a controller are positioned within a control box for a mattress replacement system.

15. A gas supply system, comprising:

a mattress including a chamber configured to contain a gas therein;

a garment including a chamber configured to contain a gas therein; and a gas supply configured to supply a gas to both the garment and the mattress; and a valve assembly in fluid communication with the gas supply, the garment, and the mattress, the valve assembly configured to selectively communicate a gas from the gas supply to one of the garment and the mattress;

wherein the valve assembly includes a valve and a first connector in fluid communication with the valve, the garment being configured to removably couple to the first connector;

wherein the mattress includes a recessed portion and is supported on a frame, at least one of the gas supply and the valve being coupled to the frame such that the at least one of the fluid supply and the valve is positioned in the recessed portion of the mattress when the mattress is supported on the frame.

16. The gas supply system of claim 1 further comprising a first valve in fluid communication with the gas supply and the mattress and a second valve in communication with the gas supply and the garment, the first valve and the second valve being configured to selectively allow a gas to be communicated to the mattress and the garment, respectively.

17. The gas supply system of claim 16 further comprising a controller configured to actuate the first valve and the second valve.

18. The gas supply system of claim 16, wherein a gas is not communicated simultaneously to both the mattress and the garment.

19. The gas supply system of claim 16, wherein a gas flow adjusting device is in fluid communication with at least one of the first valve and the second valve to maintain the gas flow rate to the first valve and the second valve at about the same gas flow rate.

20. A gas supply system, comprising:

a mattress including a chamber configured to contain a gas therein;

a garment including a chamber configured to contain a gas therein;

a gas supply configured to supply a gas to both the garment and the mattress; and a connector with an inlet, a plurality of outlets, and a valve mechanism, the inlet being in fluid communication with the gas supply, one of the plurality of outlets being in fluid communication with the mattress and another of the plurality of outlets being configured to removably couple to the garment, the valve mechanism being configured to selectively communicate a gas from the gas supply to the garment when the garment is coupled to the connector.

21. A gas supply system, comprising:

a mattress including a chamber configured to contain a gas therein;

a garment including a chamber configured to contain a gas therein;

a gas supply configured to supply a gas to both the garment and the mattress; and a connector with an inlet and a plurality of outlets, the inlet being in fluid communication with the gas supply, one of the plurality of outlets being in fluid communication with the mattress and another of the plurality of outlets being configured to removably couple to the garment, the gas supply being configured to supply a gas to both the mattress and the garment simultaneously.

22. A gas supply system, comprising:

a mattress including a chamber configured to contain a gas therein;

a garment including a chamber configured to contain a gas therein;

a gas supply configured to supply a gas to both the garment and the mattress;

a controller configured to control the operation of the gas supply; and a connector with an inlet and a plurality of outlets, the inlet being in fluid communication with the gas supply, one of the plurality of outlets being in fluid communication with the mattress and another of the plurality of outlets being configured to removably couple to the garment, the controller being configured to control the gas supply as a function of a predetermined set of characteristics of the garment.

23. The gas supply system of claim 22, wherein the connector is configured to generate a signal corresponding to the type of garment to the controller when the garment is coupled to the connector.

24. A method, comprising:

actuating a valve assembly to communicate a gas from a gas supply to a garment at a first gas flow rate to maintain a first chamber of the garment configured to contain a gas therein at a first pressure for a first period of time;

actuating the valve assembly to communicate a gas from the gas supply to the garment at a second gas flow rate to maintain the first chamber at a second pressure for a second period of time, the first gas flow rate being greater than the second gas flow rate;

sensing a gas pressure in a second chamber of a person-support surface configured to contain a gas therein; and actuating the valve assembly to communicate a gas from the gas supply to the second chamber at a third gas flow rate to maintain the pressure within the second chamber at a third pressure.

25. The method of claim 24 wherein the second gas flow rate is 0 $m^2/s$.

26. The method of claim 24, wherein the garment is configured to deliver sequential compression therapy.

27. The method of claim 24, wherein the garment is configured to deliver chest-wall oscillation therapy.

28. The method of claim 24, wherein the steps of sensing the pressure in the second chamber of the person-support surface and actuating the valve assembly to communicate a gas at a third gas flow rate from the gas supply to the second chamber to maintain the pressure within the second chamber at a third pressure occur during the second period of time.

29. The method of claim 24 further comprising the steps of:

determining whether the second period of time has elapsed; and if the second period of time has not elapsed, maintaining the pressure within the second chamber at the third pressure;

if the second period of time has elapsed, actuating the valve assembly to communicate a gas at a fourth gas flow rate from the gas supply to the second chamber.

30. The method of claim 29, wherein the fourth gas flow rate is less than the third gas flow rate.

31. The method of claim 29, wherein the fourth gas flow rate is about 0 $m^2/s$.

32. The method of claim 24 further comprising the steps of:

determining whether the second period of time has elapsed; and if the second period of time has elapsed, determining if the pressure in the second chamber is at about the third pressure;

if the second chamber is at about the third pressure, actuating the valve assembly to communicate a gas at about a fourth gas flow rate from the gas supply to the second chamber;

if the second chamber is not at about the third pressure, communicating a gas at about the third gas flow rate from the gas supply to the second chamber until the pressure within the second chamber is at about the third pressure;

if the second period of time has not elapsed, maintaining the pressure within the second chamber at the third pressure.

33. A gas supply system, comprising:

a person-support surface with a chamber configured to contain a gas;

a microclimate management topper configured to be positioned on the person-support surface;

a pneumatic device;

a gas supply configured to supply a gas to the pneumatic device and at least one of the person-support surface and the microclimate management topper.

34. The gas supply system of claim 33, wherein the pneumatic device is a garment is configured to substantially surround a portion of a person.

35. The gas supply system of claim 33, wherein the pneumatic device is a tool.

36. The gas supply system of claim 33, wherein the pneumatic device is configured to provide chest wall oscillation therapy.

37. The gas supply system of claim 33, wherein the pneumatic device is configured to provide sequential compression therapy.

38. The gas supply system of claim 33, wherein the pneumatic device is configured to provide percussion/vibration therapy.

* * * * *